US006185390B1

(12) United States Patent
Higeta et al.

(10) Patent No.: US 6,185,390 B1
(45) Date of Patent: Feb. 6, 2001

(54) ELECTROPHOTOGRAPHIC IMAGE FORMING APPARATUS HAVING PROCESS CARTRIDGE WITH PARTICULAR ARRANGEMENT OF ELECTRICAL CONTACTS

(75) Inventors: Akira Higeta, Funabashi; Minoru Sato; Shinya Noda, both of Toride, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/200,957

(22) Filed: Nov. 30, 1998

(30) Foreign Application Priority Data

Nov. 29, 1997 (JP) ..... 9-343811

(51) Int. Cl.[7] ..... G03G 15/00
(52) U.S. Cl. ..... 399/90; 399/111; 399/167
(58) Field of Search ..... 399/13, 90, 111, 399/117, 113, 88, 89, 167

(56) References Cited

U.S. PATENT DOCUMENTS

| | | | |
|---|---|---|---|
| 5,023,660 | | 6/1991 | Ebata et al. . |
| 5,331,372 | | 7/1994 | Tsuda et al. . |
| 5,331,373 | | 7/1994 | Nomura et al. . |
| 5,404,198 | | 4/1995 | Noda et al. . |
| 5,448,459 | | 9/1995 | Tsuda et al. . |
| 5,452,056 | | 9/1995 | Nomura et al. . |
| 5,475,470 | | 12/1995 | Sasago et al. . |
| 5,510,878 | | 4/1996 | Noda et al. . |
| 5,528,341 | | 6/1996 | Shishido et al. . |
| 5,583,613 | | 12/1996 | Kobayashi et al. . |
| 5,585,889 | | 12/1996 | Shishido et al. . |
| 5,602,623 | | 2/1997 | Nishibata et al. . |
| 5,608,509 | | 3/1997 | Shirai et al. . |
| 5,623,328 | | 4/1997 | Tsuda et al. . |
| 5,659,847 | | 8/1997 | Tsuda et al. . |
| 5,669,042 | | 9/1997 | Kobayashi . |
| 5,740,499 | | 4/1998 | Higeta et al. . |
| 5,749,027 | | 5/1998 | Ikemoto et al. . |
| 5,774,766 | | 6/1998 | Karakama . |
| 5,828,928 | | 10/1998 | Sasago et al. . |
| 5,867,751 | * | 2/1999 | Nomura et al. ..... 399/90 |
| 5,870,654 | | 2/1999 | Sato et al. . |
| 5,870,655 | * | 2/1999 | Nishiuwatoko et al. ..... 399/111 |
| 5,873,012 | * | 2/1999 | Miyabe et al. ..... 399/90 |
| 5,878,310 | | 3/1999 | Noda et al. . |
| 5,890,036 | | 3/1999 | Karakama . |
| 6,016,413 | * | 1/2000 | Yokoyama et al. ..... 399/113 |

FOREIGN PATENT DOCUMENTS

| | | | |
|---|---|---|---|
| 735432 | * | 10/1996 | (EP) . |
| 2-163761 | * | 6/1990 | (JP) . |

* cited by examiner

*Primary Examiner*—Robert Beatty
(74) *Attorney, Agent, or Firm*—Fitzpatrick, Cella, Harper & Scinto

(57) ABSTRACT

A process cartridge detachably mountable to a main assembly of an electrophotographic image forming apparatus, includes a cartridge frame; an electrophotographic photosensitive drum; and a cartridge coupling member for receiving a driving force for rotating the drum from the main assembly of the apparatus when the process cartridge is mounted to the main assembly of the apparatus. The coupling member is provided on one longitudinal end of the drum. The cartridge also includes a charging bias contact for receiving a charging bias from the main assembly of the apparatus when the process cartridge is mounted to the main assembly of the apparatus; and a detecting developing bias contact for receiving a developing bias to be applied to a developing member from the main assembly of the apparatus when the process cartridge is mounted to the main assembly of the apparatus; and a detecting contact for notifying the main assembly of the apparatus that the process cartridge is mounted to the main assembly of the apparatus. The three contacts are provided on the bottom, when the process cartridge is mounted to the main assembly of the apparatus, on a surface of the cartridge frame adjacent the one longitudinal end of the electrophotographic photosensitive drum, and the charging bias contact is exposed from the cartridge frame.

20 Claims, 26 Drawing Sheets

ELECTROPHOTOGRAPHIC IMAGE FORMING APPARATUS HAVING PROCESS CARTRIDGE WITH PARTICULAR ARRANGEMENT OF ELECTRICAL CONTACTS

FIELD OF THE INVENTION AND RELATED ART

The present invention relates to a process cartridge which can be removably mounted in the main assembly of an electrophotographic image forming apparatus, and an electrophotographic image forming apparatus in which such a process cartridge can be removably mounted.

In this specification, the term image forming apparatus refers to an apparatus which forms an image on a piece of recording medium with the use of an electrophotographic image formation process. An electrophotographic image forming apparatus includes an electrophotographic copying machine, an electrophotographic printer (for example, LED printer, laser beam printer, and the like), an electrophotographic facsimile machine, an electrophotographic word processor, and the like.

A process cartridge can be mounted in, or removed from, the main assembly of an electrophotographic image forming apparatus by an operator him/herself, and therefore, it simplifies the maintenance of an electrophotographic image forming apparatus.

When the use of an electrophotographic image forming apparatus, such as an electrophotographic copying machine, lasts for an extended length of time, it becomes necessary during the usage to exchange the electrophotographic photosensitive drum and/or development device of the apparatus, to replenish the apparatus with toner, or the developer, to clean the charger, to replace the cleaning means container in which the waste toner is collected, to make adjustments on the peripheral components of the electrophotographic photosensitive drum, and/or to perform like procedures.

Thus, in order to make it easier to perform the above-described maintenance, a process cartridge system has been employed in an electrophotographic image forming apparatus which employs an electrophotographic image formation process. According to this process cartridge system, an electrophotographic photosensitive drum, and various processing means, which act on the electrophotographic photosensitive drum, are integrated in the form of a cartridge, which can be removably mounted in, or removed from, the main assembly of an electrophotographic image forming apparatus. The employment of this process cartridge system makes it possible for a user him/herself to maintain the apparatus, drastically improving the operational efficiency of the apparatus. Thus, the process cartridge system has been widely in use in electrophotographic image forming apparatus.

With the wide usage of the process cartridge system, demand has been increasing for simplification of mounting and removal of a process cartridge into and out of the main assembly of an electrophotographic image forming apparatus. Demand has been also increasing for improvement in reliability and precision in terms of the electrical connection between a process cartridge and the main assembly of an electrophotographic image forming apparatus which occurs when an process cartridge is mounted in the main assembly of an electrophotographic image forming apparatus.

SUMMARY OF THE INVENTION

The primary object of the present invention is to provide a process cartridge which is reliable in terms of the electrical connection which occurs between a process cartridge and the main assembly of an electrophotographic image forming apparatus when the former is mounted in the main assembly of the latter, and also an electrophotographic image forming apparatus which accommodates such a process cartridge.

Another object of the present invention is to provide a process cartridge, a charge bias contact electrode, an development bias electrode, and a remaining toner amount detection contact electrode which are positioned on the same side as the side on which the driving force transmission coupler on the process cartridge side is positioned, in terms of the longitudinal direction of the electrophotographic photosensitive drum, and are exposed from the cartridge frame surface which faces downward after the process cartridge is properly mounted in the main assembly of the image forming apparatus, and an electrophotographic image forming apparatus which accommodates such a process cartridge.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described in detail with reference to the drawings. In this specification, the embodiments of the present invention are in the form of a laser beam printer, that is, an electrophotographic image forming apparatus. Below, the term horizontal direction perpendicular to the direction in which a process cartridge is inserted into, or removed from, the main assembly of an electrophotographic image forming apparatus will be referred to as the longitudinal direction of various components.

Figure 1:
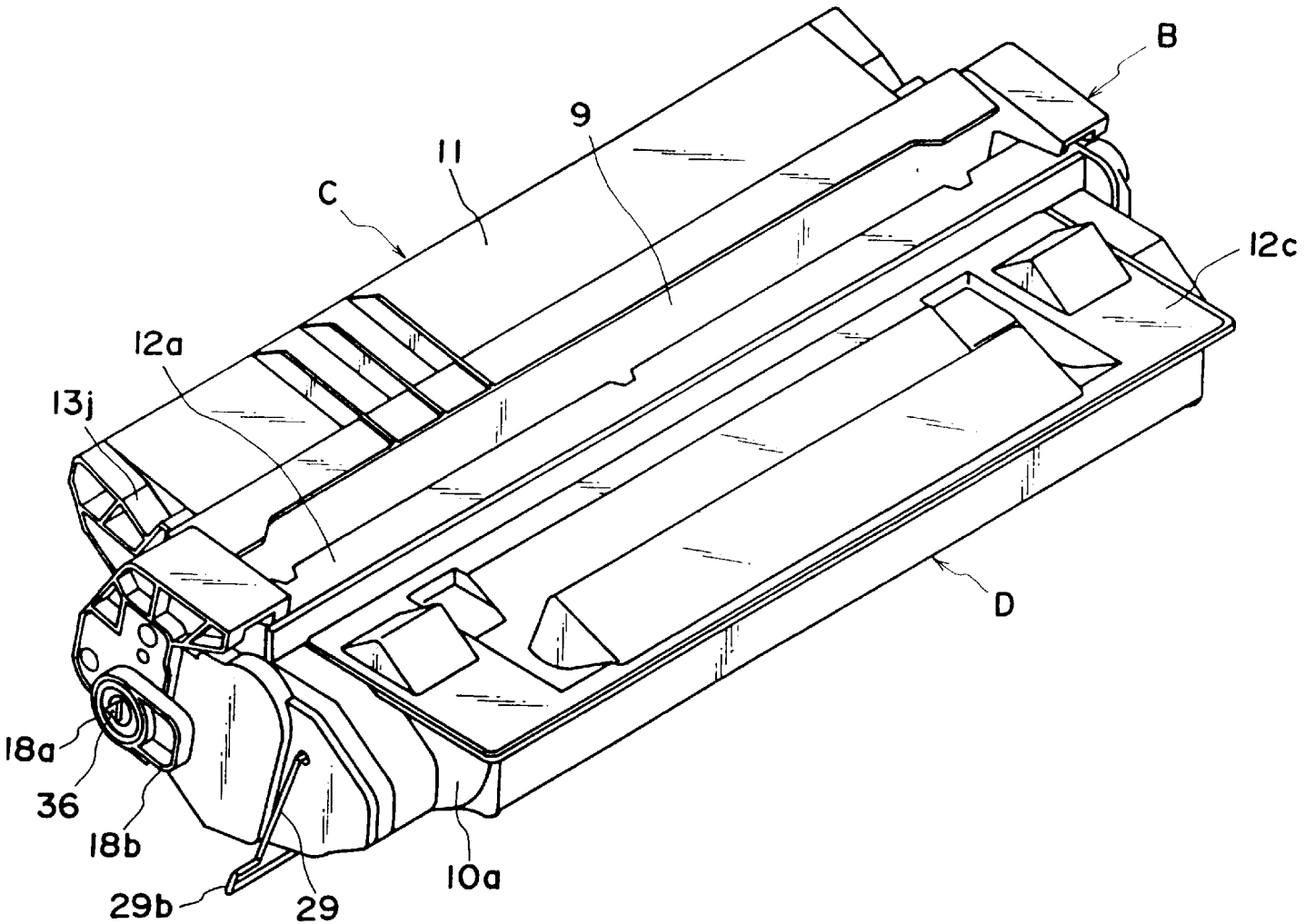
FIG. 1 is an external perspective view of a process cartridge in accordance with the present invention, as seen from diagonally above the left rear end thereof in terms of the direction in which the process cartridge is inserted into the main assembly of an electrophotographic image forming apparatus.
Figure 2:
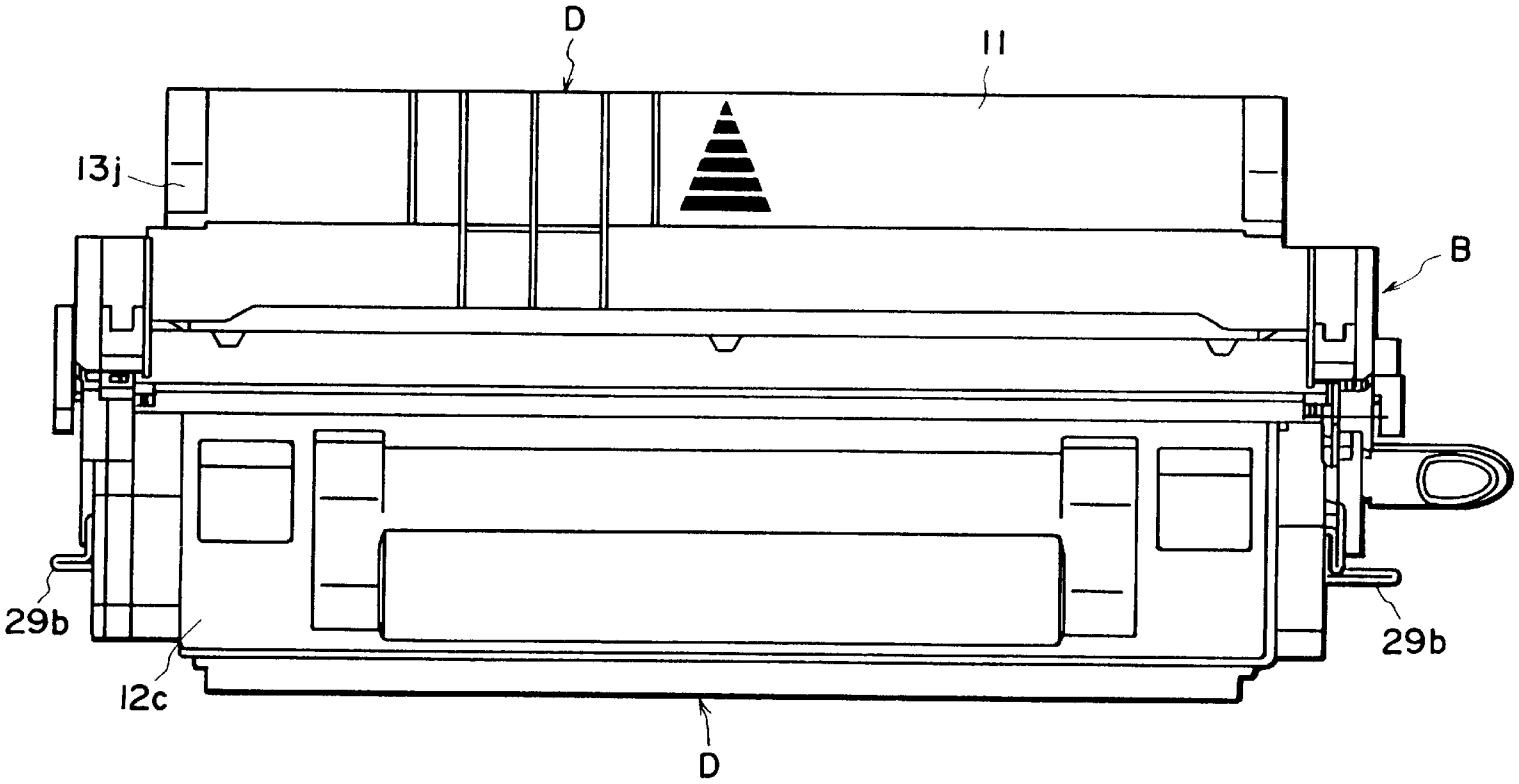
FIG. 2 is a top plan view of the process cartridge in accordance with the present invention.
Figure 3:
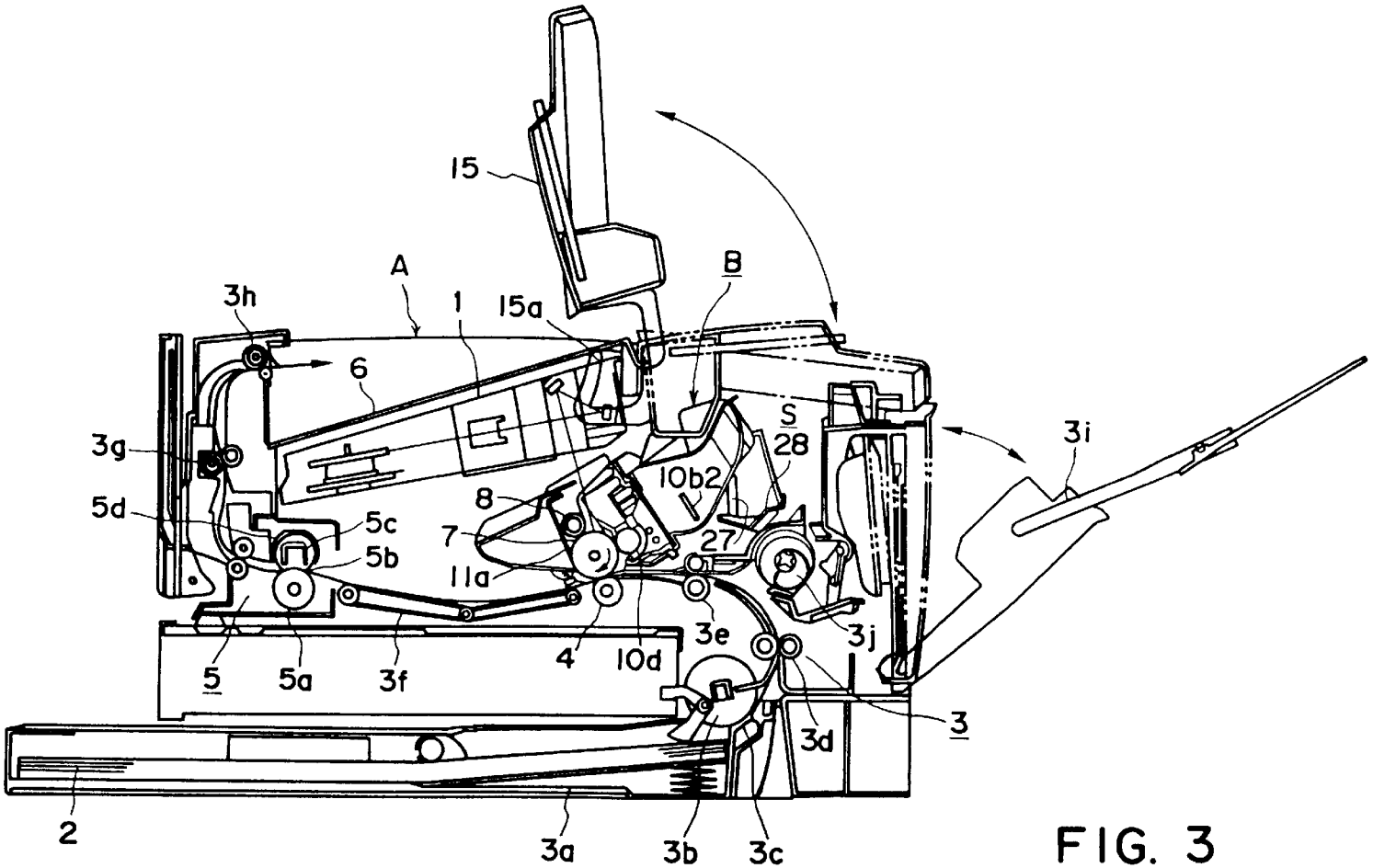
FIG. 3 is a vertical section of an electrophotographic image forming apparatus in accordance with the present invention, in which the process cartridge in accordance with the present invention has been mounted, and depicts the general structures of the image forming apparatus and the process cartridge.
Figure 4:
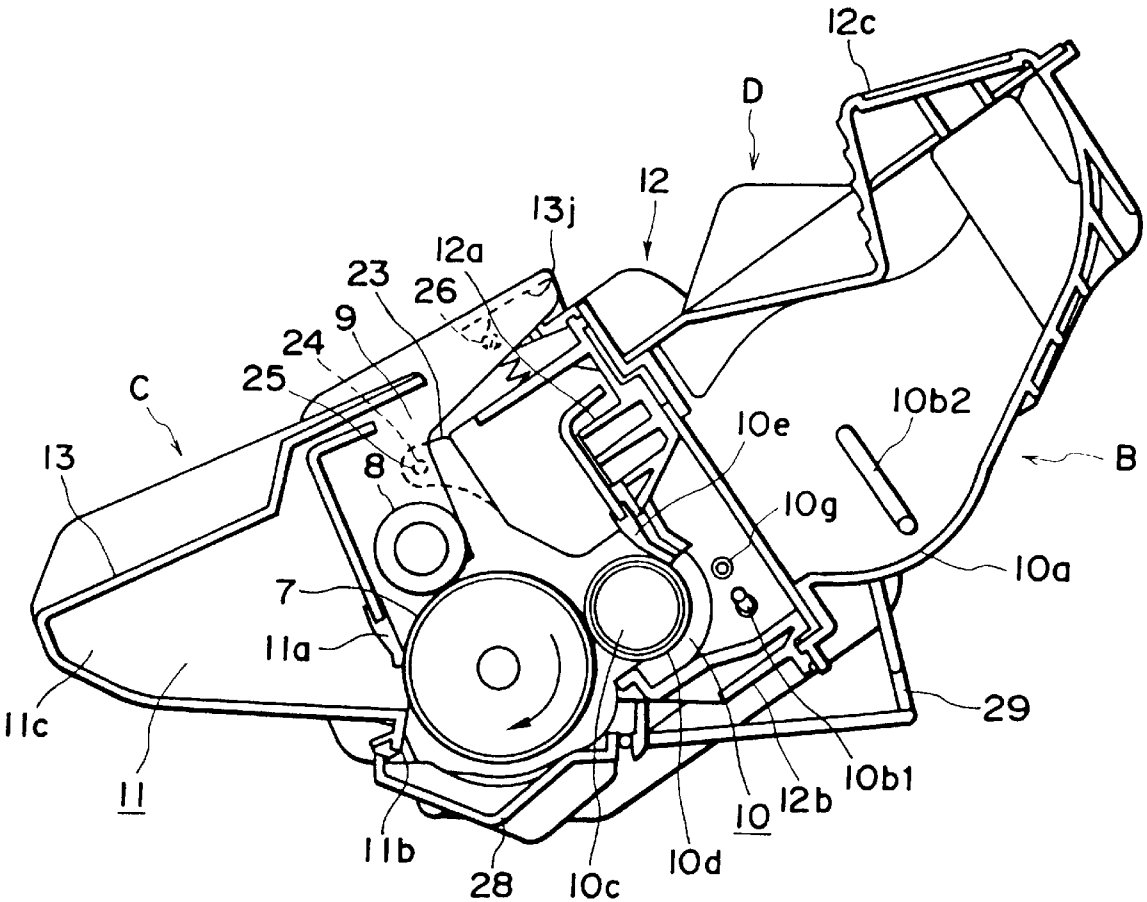
FIG. 4 is a vertical section of the process cartridge in accordance with the present invention, and depicts the general structure thereof.
Figure 5:
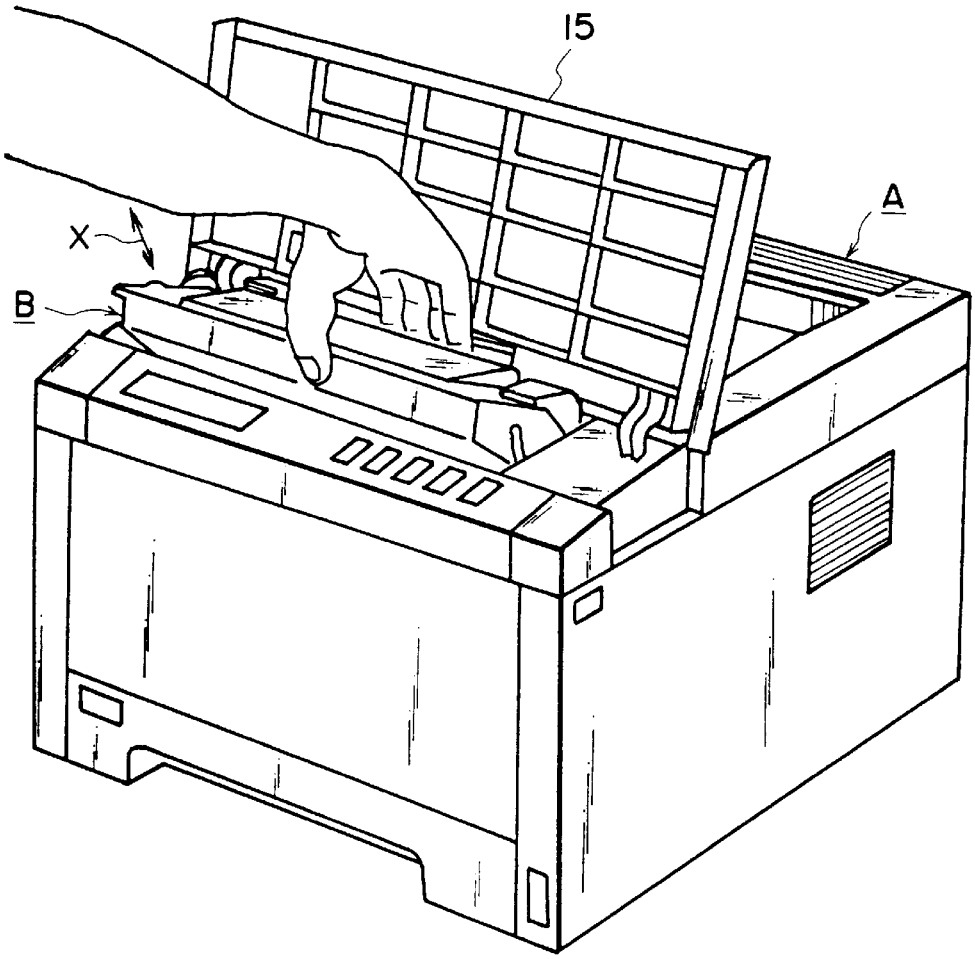
FIG. 5 is a perspective view of an electrophotographic image forming apparatus drawn to depict how a process cartridge is mounted in, or removed from, the main assembly of the apparatus.
Figure 6:
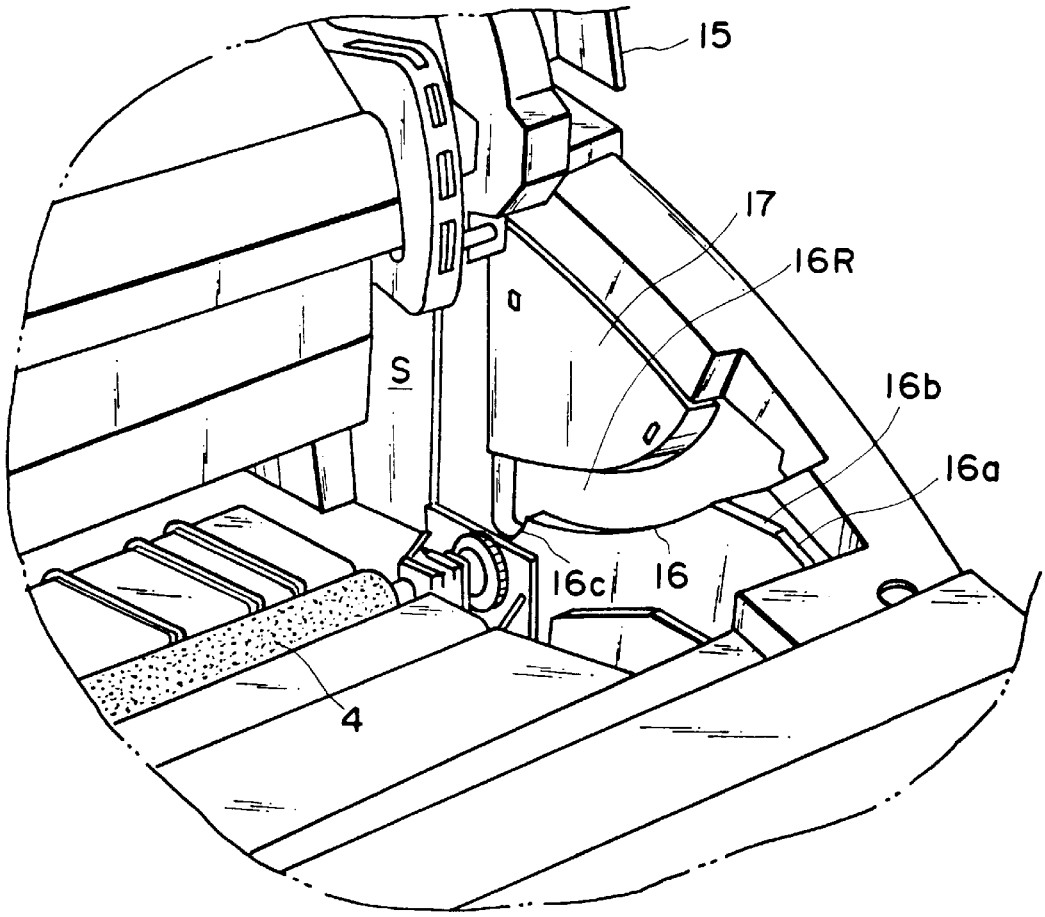
FIG. 6 is a perspective view of the right-hand guide portion of the main assembly of the image forming apparatus, which guides a process cartridge during the mounting and removal of the process cartridge.
Figure 7:
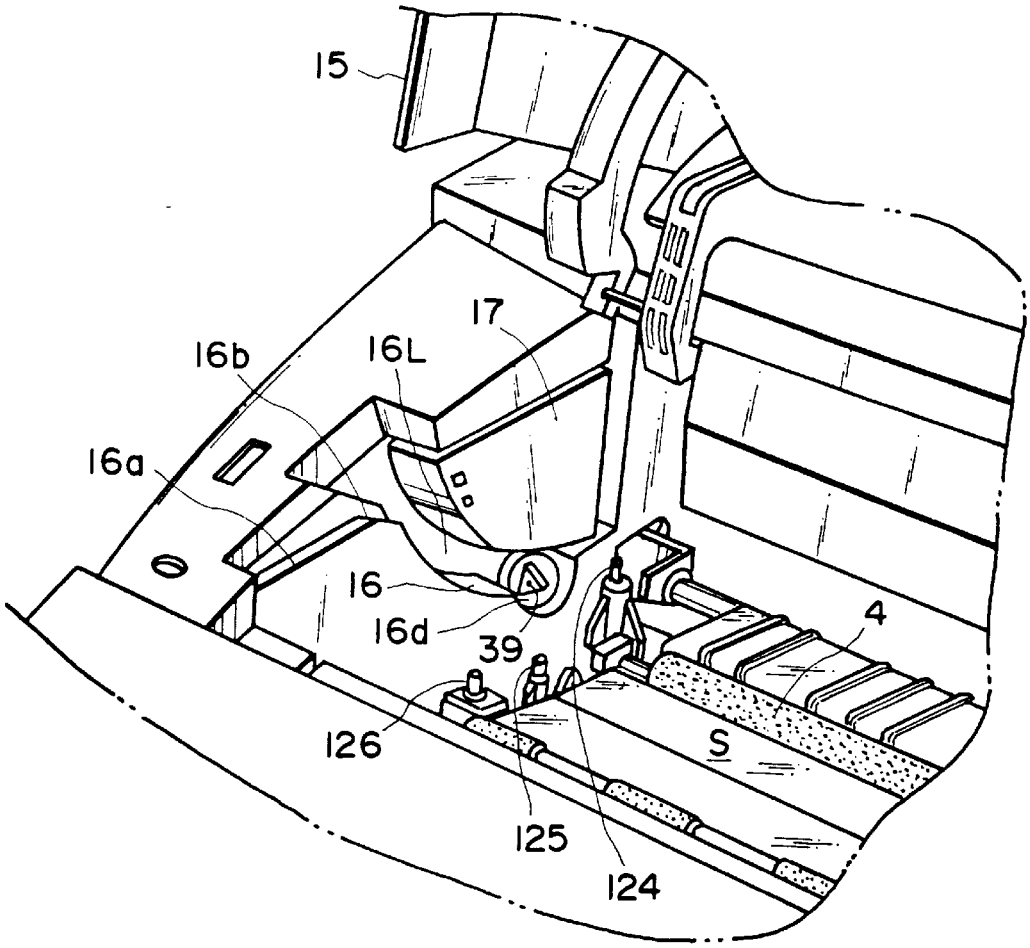
FIG. 7 is a perspective view of the left-hand guide portion of the main assembly of the image forming apparatus, which guides a process cartridge during the mounting and removal of the process cartridge.

Next, referring to FIG. 1 to FIG. 28, a process cartridge in accordance with the present invention, and an electrophotographic image forming apparatus, into, or out of, which a process cartridge in accordance with the present invention can be mounted, or removed, will be concretely described. FIG. 1 and FIG. 2 are drawings which illustrate the exterior of the process cartridge. FIG. 3 is a sectional drawing which illustrates the structure of the electrostatic image forming apparatus in which the process cartridge has been mounted. FIG. 4 is a sectional drawing which illustrates the structure of the process cartridge. FIG. 5 to FIG. 7 are drawings which illustrate the structure of the means for mounting the process cartridge. FIG. 8 to FIG. 12 are schematic drawings which depict the steps for mounting the process cartridge. FIG. 13 to FIG. 16 are drawings which depict the details of the present invention.

First, the general structure of the process cartridge, and the general structure of the electrophotographic image forming apparatus which employs the process cartridge, will be described.

I. General Structure

Referring to FIG. 3, in this electrophotographic image forming apparatus (laser beam printer), a latent image is formed, on an electrophotographic photosensitive member 7 in the form of a drum, by a beam of light projected while being modulated with image formation data, onto a photosensitive member from an optical system, and this latent image is developed into a toner image with the use of developer (hereinafter, toner). In synchronism with the toner image formation, pieces of a recording medium 2 are separated, one by one, from a plurality of sheets of a recording medium 2 set in a sheet feeder cassette 3*a*, and are sent out of the sheet feeder cassette 3*a*, by a pickup roller 3*b*, and a pressure roller 3*c* pressed upon the pickup roller 3*b*, and then, is conveyed to the transfer station, by a conveying means 3 which comprises a pair of conveyer rollers 3*d*, a pair of registration rollers 3*e*, and the like. In the transfer station, the toner image formed on the electrophotographic photosensitive member 7 in the process cartridge B is transferred onto the recording medium 2 as voltage is applied to a transfer roller 4 as a toner image transferring means. Thereafter, the recording medium 2 is conveyed to a fixing means 5 by a conveyer belt 3*f*. The fixing means 5 comprises a driving roller 5*a* and a rotative fixing member 5*d*. The rotative fixing member 5*d* is in the form of a hollow cylinder, and contains a heater 5*b*. It is rotatively supported by a supporting member 5*c*. The fixing means 5 fixes the toner image, which has been transferred onto the recording medium 2, to the recording medium 2 by the application of heat and pressure while the recording medium 2 is being passed through the fixing member 5. Then, the recording medium 2 is further conveyed through the reversing path, and then is discharged into the delivery station 6, by pairs 3*g* and 3*h* of discharge rollers. This electrophotographic image forming apparatus also comprises a head feeding tray 3*i* and a roller 3*j*, which make it possible for the operator to manually feed the recording medium 2.

II. Process Cartridge Structure

The process cartridge B comprises an electrophotographic photosensitive member and at least one of the processing means. The processing means includes a charging means for charging the electrophotographic photosensitive member, a developing means for developing a latent image formed on the electrophotographic photosensitive member, a cleaning means for cleaning the toner particles which are remaining on the peripheral surface of the electrophotographic photosensitive member, and the like. Referring to FIG. 4, in the process cartridge B in this embodiment, a photosensitive drum 7, that is, an electrophotographic photosensitive member with a photosensitive layer, is rotatively driven, and as it is driven, its peripheral surface is uniformly charged by applying voltage to a charge roller 8, that is, by a charging means. Onto the peripheral surface of the uniformly charged photosensitive member 7, an optical image is projected from the aforementioned optical system 1 through an opening 9, forming a latent image on the peripheral surface of the photosensitive member 7. The thus formed latent image is developed by a developing means 10.

The developing means 10 comprises a toner storage portion 10*a*, first and second toner sending members 10*b*1 and 10*b*2, a development roller 10*d*, and a development blade 10*e*. The development roller 10*d* is a rotative member which contains a fixedly disposed magnet 10*c*. In operation, the toner is sent out of the toner storage portion of the developer container by the first and second toner sending members 10*b*1 and 10*b*2, toward the development roller 10*d* which is being rotated. As the toner reaches the development roller 10*d*, it is borne in a uniform layer on the peripheral surface of the development roller 10*d* while being triboelectrically charged by the development blade 10*e*. Then, the toner is transferred onto the peripheral surface of the photosensitive member 7, in the pattern of the aforementioned latent image. As a result, the latent image is developed into a visual image, or a toner image.

Next, the toner image is transferred onto the recording medium by applying, to the transfer roller 4, voltage with a polarity opposite to that of the toner image. Then, the residual toner, that is, the toner which remains on the photosensitive member 7, is removed by a cleaning means 11, which comprises a cleaning blade 11*a*, a scooping sheet 11*b*, and a waste toner storage portion 11*c*. More specifically, the residual toner is scraped off the photosensitive member 7 by the cleaning blade 11*a*, and is scooped up and collected into the waste toner storage portion 11*c* by the scooping sheet 11*b*.

The photosensitive member 7 and the transfer roller 4 make contact with each other through an opening of the cartridge frame, which is covered with a shutter 28. The shutter 28 is attached to the cartridge frame with the use of a mechanical linkage with four povitable joints, which comprises a link member 29 and an arm member 27 (FIG. 3, and FIG. 8 to FIG. 12).

The aforementioned photosensitive drum 7 and other components are integrated in the form of a cartridge. More specifically, the top and bottom portions 12*a* and 12*b*, respectively, of the developing means frame 12, the toner chamber portion 10*a*, and the cover 12*c*, are welded together, completing the development chamber frame 12. Then, the development chamber frame 12 is joined with the cleaning means frame 13, that is, a cleaning means container, to complete the cartridge frame. The photosensitive drum 7 and the other components are disposed in the thus formed cartridge frame. The cartridge can be removably mounted on the cartridge mounting means provided in the main assembly A of an electrophotographic image forming apparatus (hereinafter, image forming apparatus main assembly).

III. Structure of Mounting and Removing Process Cartridge

Next, the structure for mounting or removing the process cartridge B into and out of the image forming apparatus main assembly A will be described.

Referring to FIG. 5, the process cartridge B is mounted or removed by opening a cover 15. Referring to FIG. 6 and FIG. 7, as the cover 15 is opened by rotating it about the shaft 15*a* (FIG. 3), the cartridge mounting space S with the cartridge mounting means is exposed. The cartridge mounting means comprises guide rails 16 and guide members 17, with which the left- and right-hand walls of the cartridge mounting space S are provided one for one. They are symmetrically disposed across the space S, and the guide member 17 is located immediately above the guide rail 16. The guide rail 16 is slanted downward on the front side in terms of the cartridge mounting direction, and consists of first and second slant surfaces 16*a* and 16*b*, respectively. The first slant surface 16*a* is on the entrance side and constitutes a catch portion with which the projection portion 29*b* (FIG. 1) of the link member 29 for opening or closing the shutter 28 of the process cartridge B engages. The second slant surface 16*b* continues downward from the first slant surface 16*a*, slightly bowing downward (approximately in the form of an arc, in this embodiment), and its angle is steeper than that of the first slant surface 16*a*.

On the other hand, the process cartridge B is provided with left- and right-hand guide portions, which approximately symmetrically project outward from the lateral surfaces of the left- and right-hand longitudinal ends, respectively. The guide portions of the process cartridge B are guided by the guide rails 16. Referring to FIG. 1, a cylindrical guide 18*a* which constitutes the first guide portion, and a rotation control guide 18*b* which constitutes the second guide portion, are integral with each other. They are also located on the opposite side of the cartridge frame, although this is not illustrated. The cylindrical guide 18*a* is positioned so that its center is aligned with the rotational axis of the photosensitive member 7. The rotation control guide 18*b* extends rearward from the cylindrical guide 18*a*, in terms of the cartridge insertion direction. The bottom portion of the rotation control guide 18*b* slightly bulges downward (approximately in the form of an arc, in this embodiment).

Figure 8:
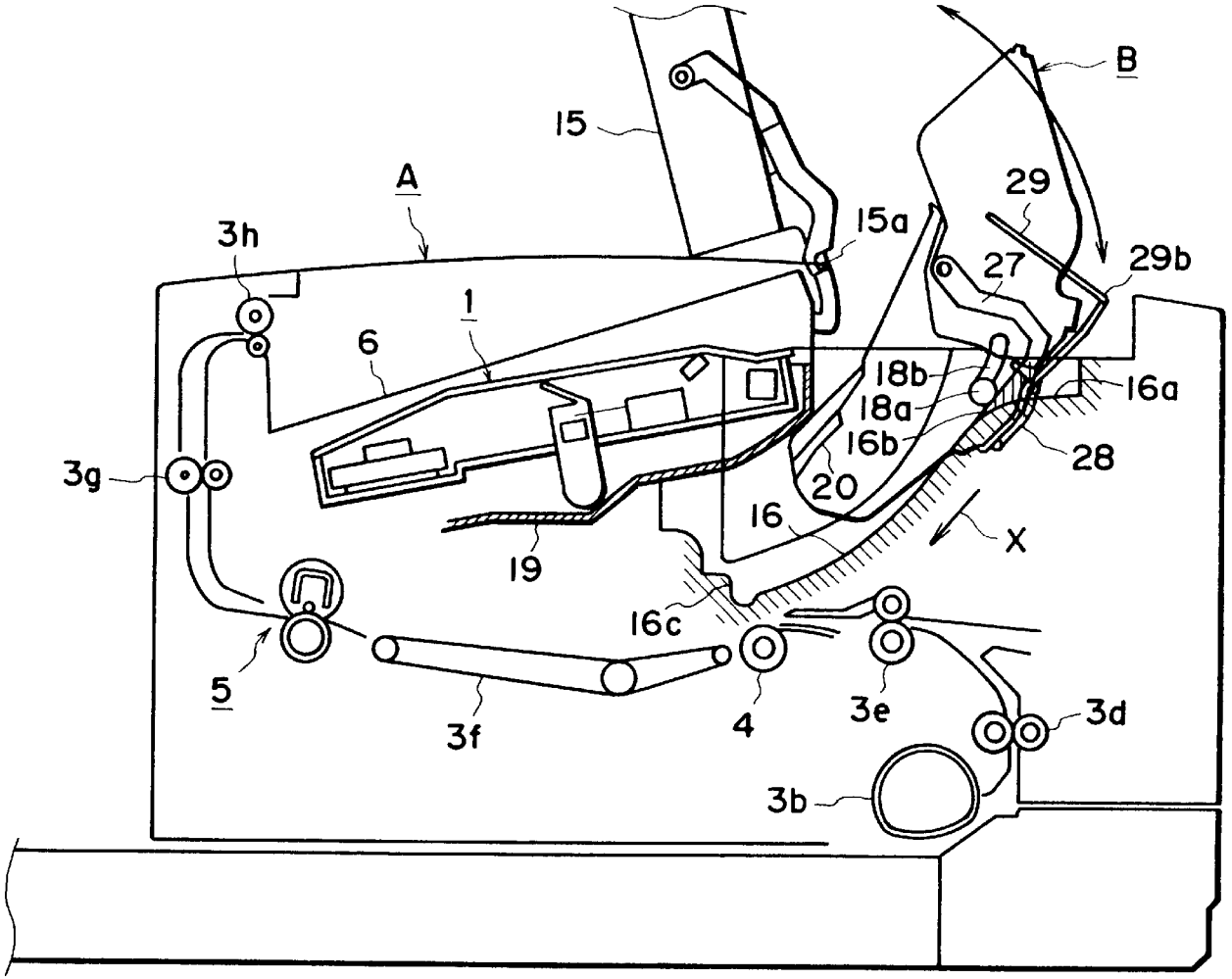
FIG. 8 is a schematic drawing which depicts the first step for mounting a process cartridge into the main assembly of an image forming apparatus.
Figure 9:
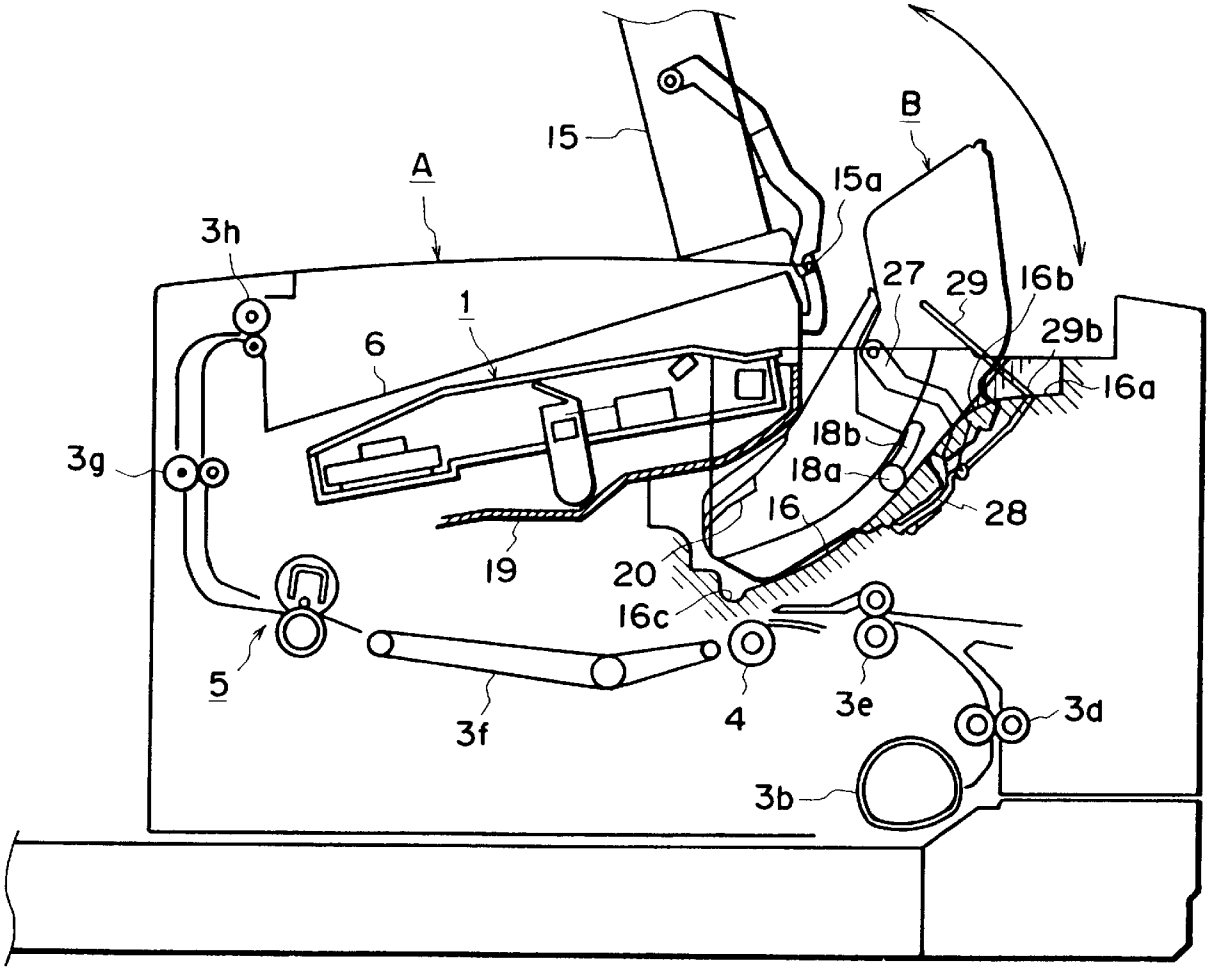
FIG. 9 is a schematic drawing which depicts the second step for mounting the process cartridge into the main assembly of an image forming apparatus.
Figure 10:
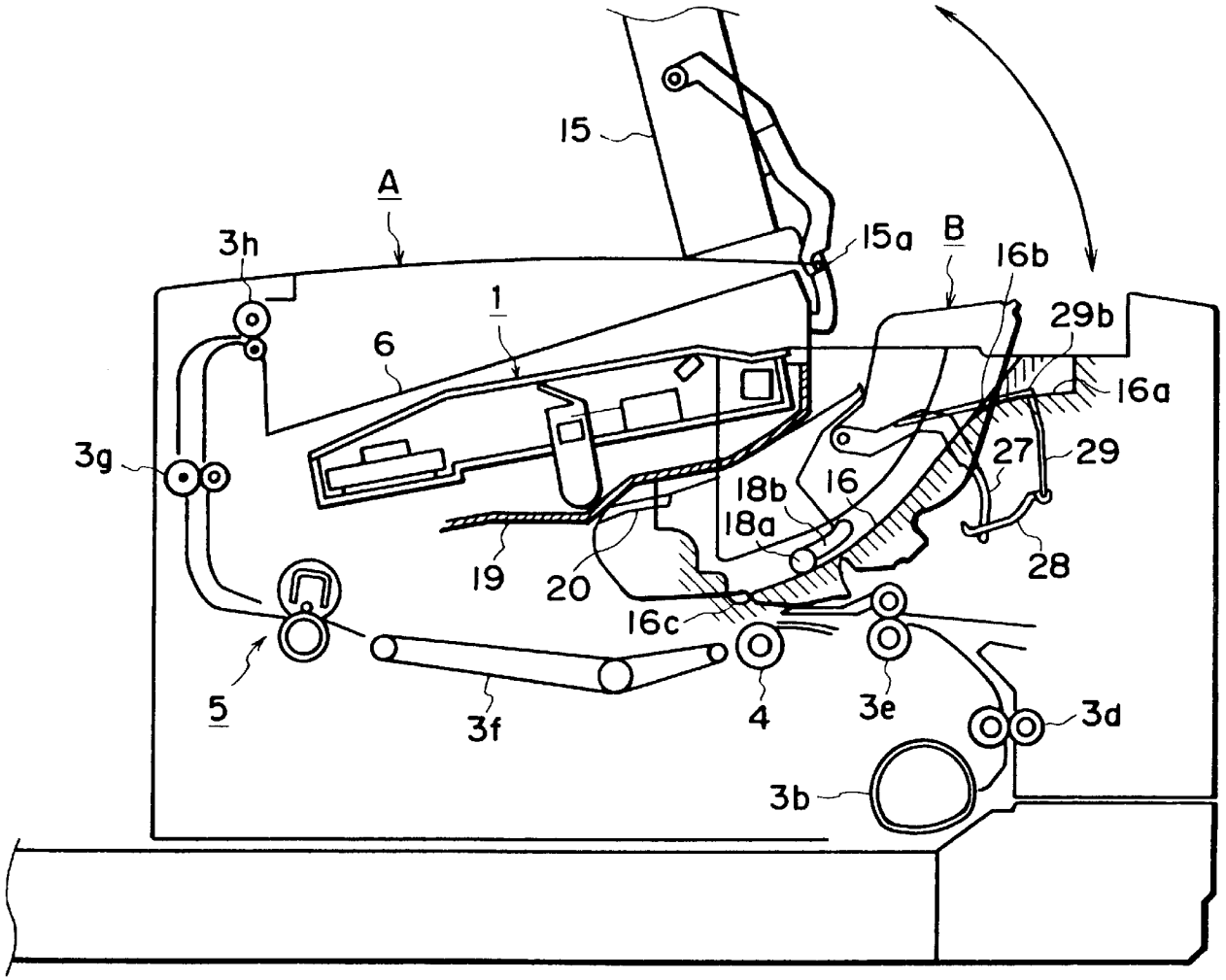
FIG. 10 is a schematic drawing which depicts the third step for mounting the process cartridge into the main assembly of an image forming apparatus.
Figure 11:
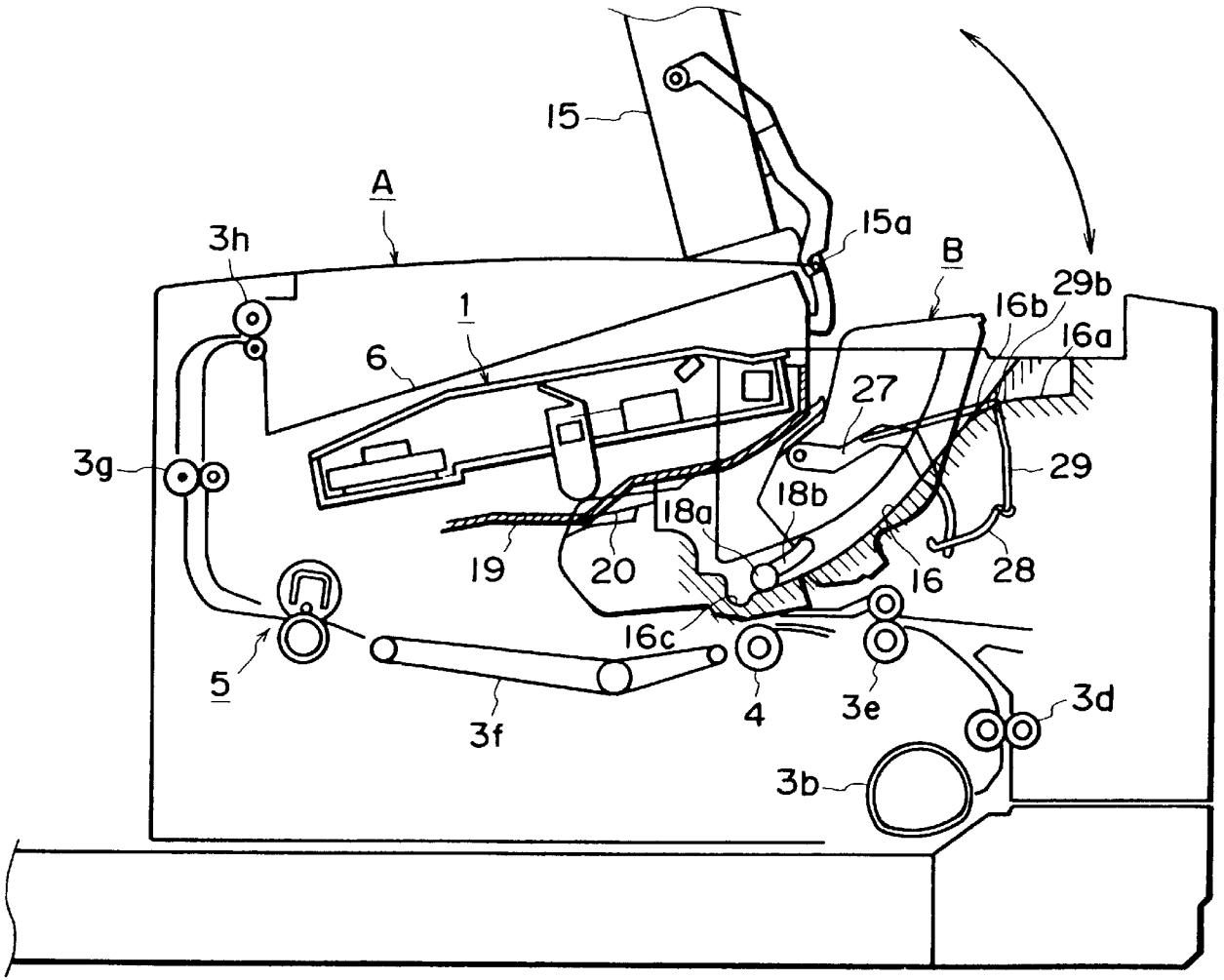
FIG. 11 is a schematic drawing which depicts the fourth step for mounting the process cartridge into the main assembly of an image forming apparatus.
Figure 12:
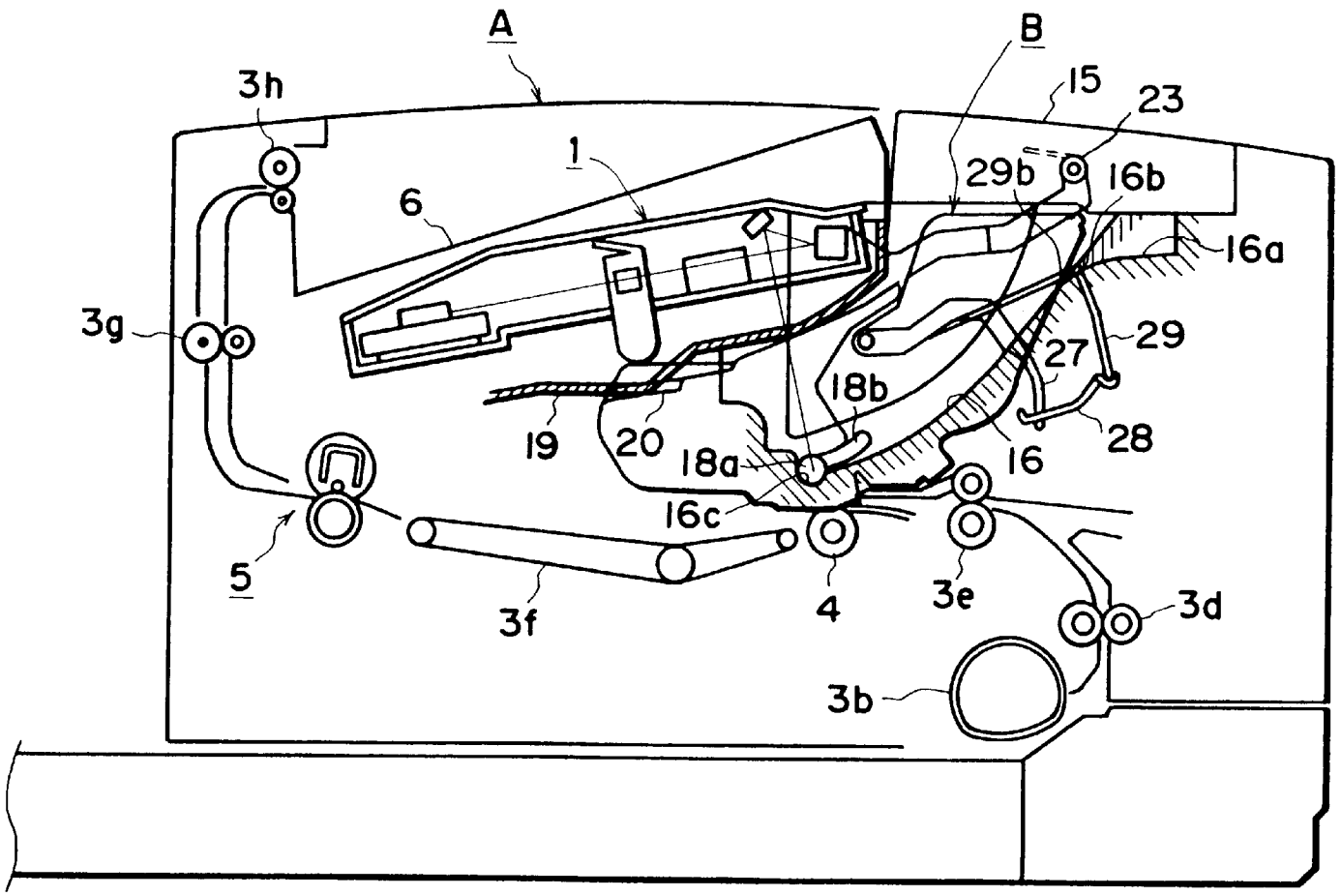
FIG. 12 is a schematic drawing which depicts the final step for mounting the process cartridge into the main assembly of an image forming apparatus.

Referring to FIG. 8 to FIG. 12, in order to mount the process cartridge B structured as described above, first, the cylindrical guide 18*a* and the rotation control guide 18*b* are placed in contact with the guide rail 16, and then, the process cartridge B is inserted into the image forming apparatus main assembly A, the guides 18*a* and 18*b* being slid on the guide rail 16, so that the leading end of the process cartridge B goes under the optical system 1. As described above, the guide rail 16 is bowed downward approximately in the form of an arc, and also, the guide member 17 is given a shape similar to that of the guide rail 16. Further, the bottom portion of the rotation control guide 18*b* is given a shape similar to that of the guide rail 16. Therefore, as the process cartridge B is inserted into the image forming apparatus main assembly A, it gradually becomes horizontal as illustrated in FIG. 9 to FIG. 11. Then, as the process cartridge B is inserted farther, a catching surface 20 of the cleaning means frame 13, which is located at left- and right-hand front ends in terms of the cartridge insertion direction, comes in contact with the projection 19 provided on the image forming apparatus main assembly A side, and the cylindrical guide 18*a* of the process cartridge B drops into a positioning groove 16*c* located at the deepest end of the guide rail 16. With this action, a driving force transmission member 36, which is a portion of a drum gear (referential character "7*b*" in FIG. 13) unillustrated in FIG. 12, is readied to be engaged with a driving force transmission member 39 (FIG. 7) on the image forming apparatus main assembly A side. At the same time as the process cartridge B is mounted as described above, the outwardly projecting portion 29*b* of the link member 29, which supports the shutter 28, is caught by the first and second projection catching surfaces 16*a* and 16*b*, being prevented from entering further into the image forming apparatus main assembly A. Therefore, as the process cartridge B is inserted further into the image forming apparatus main assembly A, the shutter 28 is opened.

As described above, the housing of the process cartridge B in this embodiment is formed by, first, forming the developing means frame 12 by joining the toner storage portion 10*a* as the toner chamber frame, with the top and bottom portions 12*a* and 12*b*, respectively, of the developing means frame 12, and then, joining the thus formed developing means frame 12 with the cleaning means frame 13. Next, the structure of the process cartridge B will be described.

Referring to FIG. 4, the toner sending member 10*b* is rotatively attached to the toner storage portion 10*a*. The development roller 10*d* and the development blade 10*e* are attached to the top portion 12*b* of the developing means frame 12. Further, the toner sending member 10*b*1 for circulating the toner in the development chamber is rotatively attached to the top portion 12*b* of the developing means frame 12, adjacent to the development roller 10*d*. Also to the bottom portion 12*b* of the developing means frame 12, a rod antenna 10*g* is attached, adjacent to the development roller 10*d*, approximately parallel to the development roller 10*d*, as illustrated in FIG. 4. The toner chamber frame 11 formed by welding the top lid 12*c* to the toner storage portion 10*a*, and the developing means frame 12, which consists of the top and bottom portions 12*a* and 12*b*, are welded together (in this embodiment, welded with ultrasonic waves), forming a development unit D as the second cartridge frame.

Referring again to FIG. 4, the photosensitive member 7, the charge roller 8, and the components of the cleaning means 10, are attached to the cleaning means frame 13, and together, they constitute a cleaning unit C as the first cartridge frame.

Figure 15:
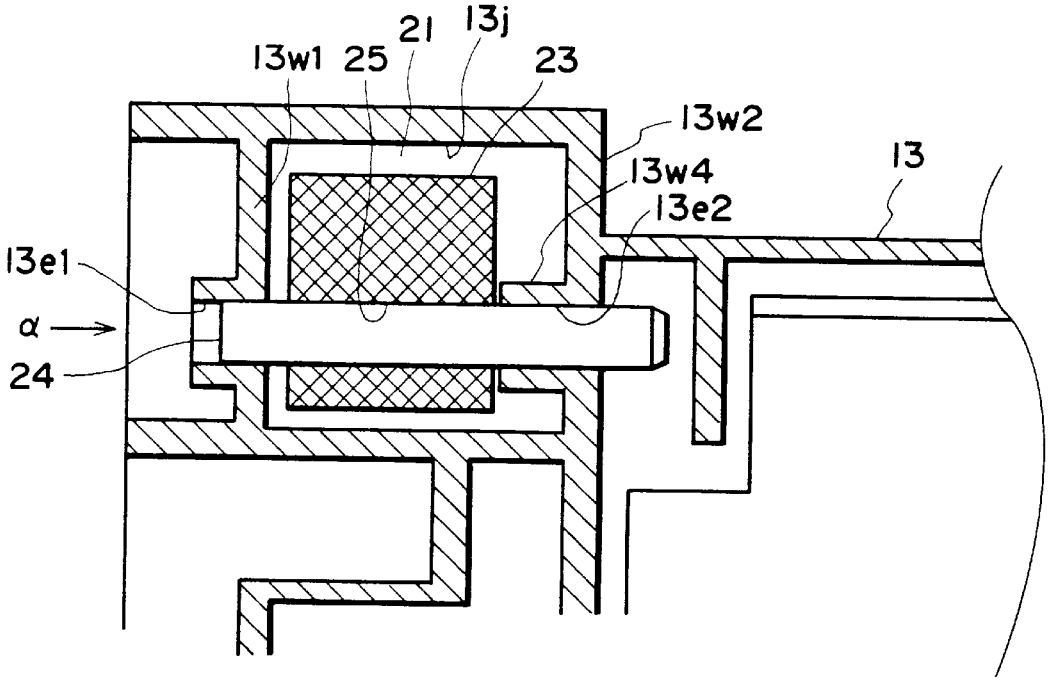
FIG. 15 is a vertical section, at a plane parallel to the longitudinal direction of the photosensitive drum, of the portion of a process cartridge, at which the cleaning means frame of the process cartridge, and the development means frame of the process cartridge, are joined.

The aforementioned development unit D and the cleaning unit C are pivotally joined (connected) with the use of a connecting member 24 in the form of a cylindrical pin, to form the process cartridge B. More specifically, referring to FIG. 4 and FIG. 5, each longitudinal end (in terms of axial line of development roller 10*d*) of the developing means frame 12 is provided with an arm portion 23, the tip of which is provided with a cylindrical hole 25 which extends in the direction parallel to the development roller 10*d*. On the other hand, each longitudinal end of the cleaning means frame 13 is provided with a recess 21 in which the aforementioned arm portion 23 fits (FIG. 15). In joining the development unit D with the cleaning unit C, the arm portion 23 is fitted into the recess 21, and the connecting member 24 is pressed from the outward side into the hole 13*e*1 of the outward wall 13*w*1 of the cleaning means frame 13 (direction indicated by an arrow mark "I"), put through the cylindrical hole 25 of the arm portion 23 of the developing means frame 12, and anchored in the hole 13*e*2 of the cleaning means frame 13, so that the development unit D and the cleaning unit C can be pivoted relative to each other about the connecting member 24 after they are joined. The anchoring hole 13*e*2 is provided in a boss 13*w*4 which projects outward from the wall 13*w*2 of the toner storage portion 10*a*, which is on the inward side of the wall 13*w*1, in terms of the longitudinal direction of the process cartridge B. As the development unit D and the cleaning unit C are joined, a compression coil spring 26 (FIG. 4) fitted around an unillustrated dowel which projects from the base portion of the arm portion 23 comes in contact with the top wall 13*j* of the recess 21 of the cleaning means frame 13, being thereby compressed. As the compression coil spring 26 is compressed, it generates pressure in the direction to press the developing means frame (top and bottom portions 12*a* and 12*b*) downward, assuring that the development roller 10*d* is pressed upon the photosensitive member 7. With the above described structural arrangement, a spacer ring (unillustrated), which is greater in diameter than the development roller 10*d*, and is fitted around both longitudinal ends of the development roller 10*d*, is pressed upon the peripheral surface of the photosensitive member 7, maintaining a predetermined gap (approximately 300 $\mu$m) between the peripheral surfaces of the photosensitive member 7 and the development roller 10*d*. Thus, the development unit D and the cleaning unit C are pivotable about the connecting member 24 relative to each other, and the predetermined positional relationship between the peripheral surfaces of the photosensitive member 7 and the development roller 10*d* is accurately maintained by the elastic force of the compression coil spring 26.

IV. Structure of Coupling Means for Transmitting Driving Force

Next, the coupling means which constitutes a part of the mechanism for transmitting the force for driving the process cartridge B from the image forming apparatus main assembly A to the process cartridge B will be described.

Figure 13:
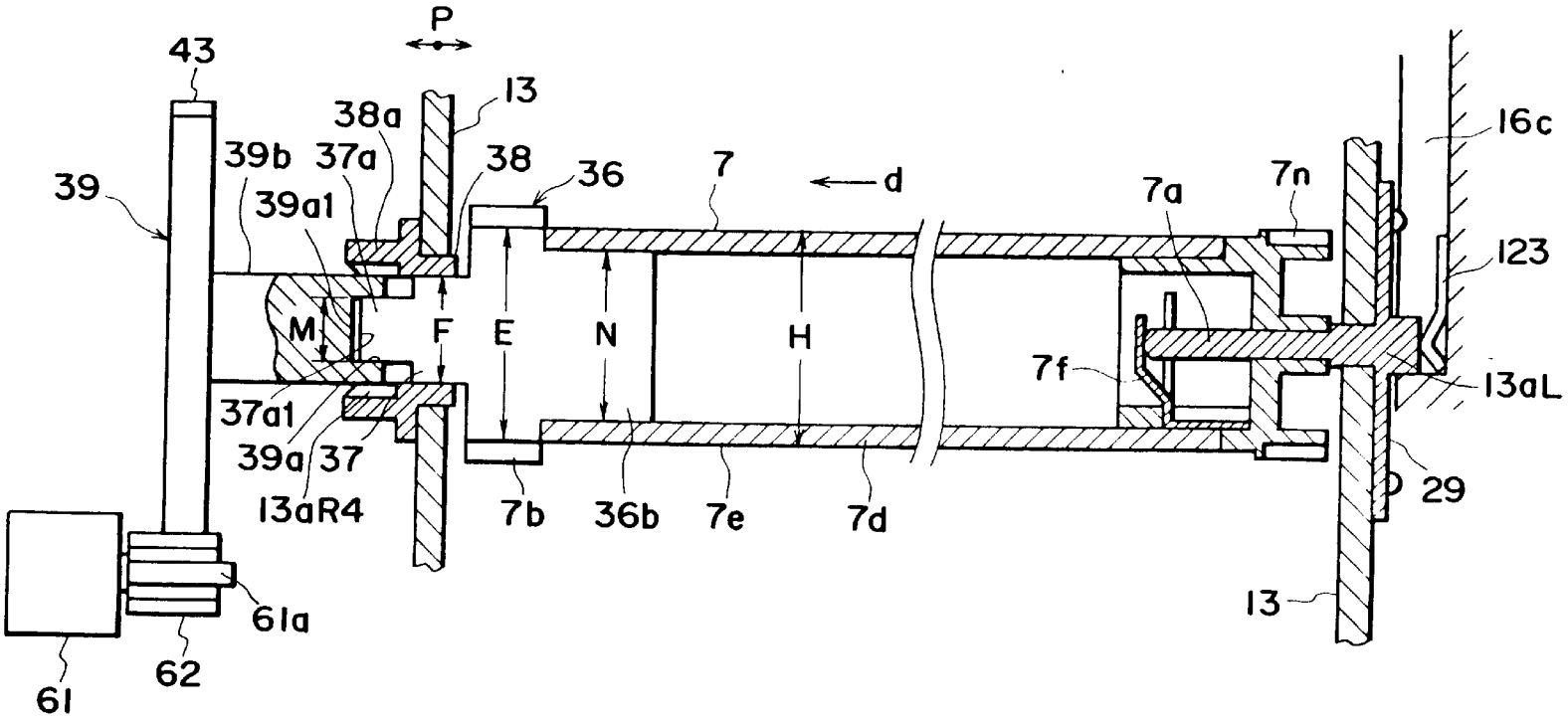
FIG. 13 is a vertical section of a photosensitive drum and the portion of an image forming apparatus, where the photosensitive drum is driven.

FIG. 13 is a vertical section of the coupling means, which consists of a portion on the photosensitive member 7 side and a portion on the image forming apparatus main assembly A side. In the drawing, the process cartridge B has been mounted in the image forming apparatus main assembly A.

Referring to FIG. 13, one of the longitudinal ends of the photosensitive member 7, disposed in the process cartridge B, is provided with a coupling means, or a driving force transmission member, which is fixed to one of the longitudinal ends of the photosensitive member 7. The coupling means consists of a drum flange 36, and a male coupler shaft 37 (cylindrical) which extends outward from the drum flange 36. The male coupler shaft 37 is provided with a coupling projection 37*a*, which is located on the end surface of the male coupler shaft 37. The end surface of the coupling projection 37*a* is parallel to the end surface of the male coupler shaft 37. The male coupler shaft 37 is borne by a bearing 38, and functions as the rotational axle for the photosensitive member 7. In the embodiment, the drum flange 36, the male coupler shaft 37, and the coupling projection 37*a*, are integral. The drum flange 36 is also integral with a helical drum gear 7*b* for transmitting the driving force to the development roller 10*d* within the process cartridge B. In other words, the drum flange 36 is integral with the drum gear 7*b*, the male coupler shaft 37, and the coupling projection 37*a*, constituting a component for transmitting the driving force.

The coupling projection 37*a* is in the form of a twisted polygonal prism. More specifically, it is approximately equilaterally triangular in cross section perpendicular to its axial line, and is gradually twisted in its rotational direction. The coupling hole 39*a* with which the coupling projection 37*a* couples is polygonal in cross section perpendicular to its axial line, and is also gradually twisted in its rotational direction. The coupling projection 37*a* and the coupling hole 39*a* are twisted in the same direction, at approximately the same pitch. The cross section of the coupling hole 39*a* perpendicular to its axial line is approximately equilaterally triangular. The coupling hole 39*a* is provided in a female coupler shaft 39*b* integral with a gear 43 with which the image forming apparatus main assembly A is provided. The female coupler shaft 39*b* with the coupling hole 39*a* is rotatively borne by the image forming apparatus main assembly A, with the provision of a predetermined amount of play in its axial direction. With the provision of the above described structure, as the process cartridge B is mounted in the image forming apparatus main assembly A, the coupling projection 37*a* of the coupling means is coupled in the coupling hole 39*a* of the female coupler shaft 39*b* of the coupling means on the image forming apparatus main assembly A side, and the rotative force is transmitted from the female coupler shaft 39*b* to the male coupler shaft 37. As the rotative force is transmitted from the female coupler shaft 39*b* to the male coupler shaft 37, the longitudinal edges of the coupling projection 37*a*, which are approximately in the form of an equilateral triangular prism, evenly contact the internal surfaces of the coupling hole 39*a* of the female coupler shaft 39*b*. Therefore, the axial line of the former aligns with that of the latter. In order to facilitate such alignment, the coupling means is manufactured so that the diameter of the circumcircle of the coupling projection 37*a* becomes larger than that of the circle inscribed in the coupling hole 39*a*, but is smaller than that of the circumcircle of the coupling hole 39*a*. Further, because of the directions in which the coupling hole 39*a* and the coupling projection 37*a* are twisted, as the female coupler shaft 39*b* is rotated, force a is generated in the direction to pull the coupling projection 37*a* into the coupling hole 39*a*, causing the end surface 37*a*1 of the coupling projection 37*a* of the male coupler shaft 37 to come in contact with the bottom surface 39*a*1 of the coupling hole 39*a*. Further, the thrust generated by this coupling means and the drum gear 7*b* works in the direction indicated by an arrow mark d. Therefore, the photosensitive member 7, which is integral with the coupling projection 37*a* of the coupling means, is rendered positionally stable relative to the image forming apparatus main assembly A, in terms of both the longitudinal direction and the direction radial to the longitudinal direction.

In this embodiment, as seen from the photosensitive member 7 side, the direction in which the outward end of the projection 37*a* is twisted relative to the base side of the coupling projection 37*a* is opposite to the rotational direction of the photosensitive member 7, and the direction in which the bottom of the coupling hole 39*a* is twisted relative to the entrance side of the coupling hole 39*a* is also opposite to the rotational direction of the photosensitive member 7. Further, the direction in which the teeth of the drum gear 7*b* integral with the drum flange 36 is aligned are opposite to the direction of the twist of the coupling projection 37*a*.

The male coupler shaft 37 and the coupling projection 37*a* are integral with the drum flange 36, and are positioned so that their axial lines align with the axial line of the photosensitive member 7 after the drum flange 36 is attached to one of the longitudinal ends of the photosensitive member 7. A reference character 36*b* designates a portion, the peripheral surface of which fits with the internal surface of the base cylinder 7*d* of the photosensitive member 7 as the drum flange 36 is attached to the photosensitive member 7. As for the method for fixing the drum flange 36 to the photosensitive member 7, crimping, gluing, or the like, is used. The peripheral surface of the base drum 7*d* is covered with a photosensitive layer 7*e*.

As described previously, the spur gear 7*n* is fixed to the other end of the photosensitive member 7.

As for the material for the drum flange 36 and the spur gear 7*n*, resin such as polyacetal, polycarbonate, polyamide, or polybutyleneterephthalate is used. Obviously, it is optional to use material other than those listed above.

The photosensitive member 7, the drum flange 36, and the male coupler shaft 37, have the following relationship as illustrated in FIG. 13. That is, the external diameter (H) of photosensitive member 7, the diameter (E) of the drum gear 7*b* at the tooth base, the internal diameter (F) of the bearing 38 for the photosensitive member 7 (external diameter of male coupler shaft 37), the diameter (M) of the circumcircle of the coupling projection 37*a*, and the external diameter (N) of the portion of the drum flange 36, which fits within the photosensitive member 7 (internal diameter of drum base 7*d*), have the following relationship:

$H>F\geqq M$, and $E>N$.

Since H>F, the frictional resistance between the bearing 38 and the male coupler shaft 37 is smaller than the frictional resistance which would be generated if the photosensitive member 7 is supported directly by the drum base 7*d*. Since $F\geqq M$, the mold for the drum flange 36 and the other members integral with the drum flange 36, which normally is parted as shown by a double heated arrow P with a center dot, requires no undercut portion, making it possible to simplify the mold.

Further, since E>N, the mold portion for the gear portion is on the left-hand side of the mold in terms of the process cartridge B insertion direction, and therefore, the durability of the mold can be increased by simplifying the right-hand side of the mold.

Figure 14:
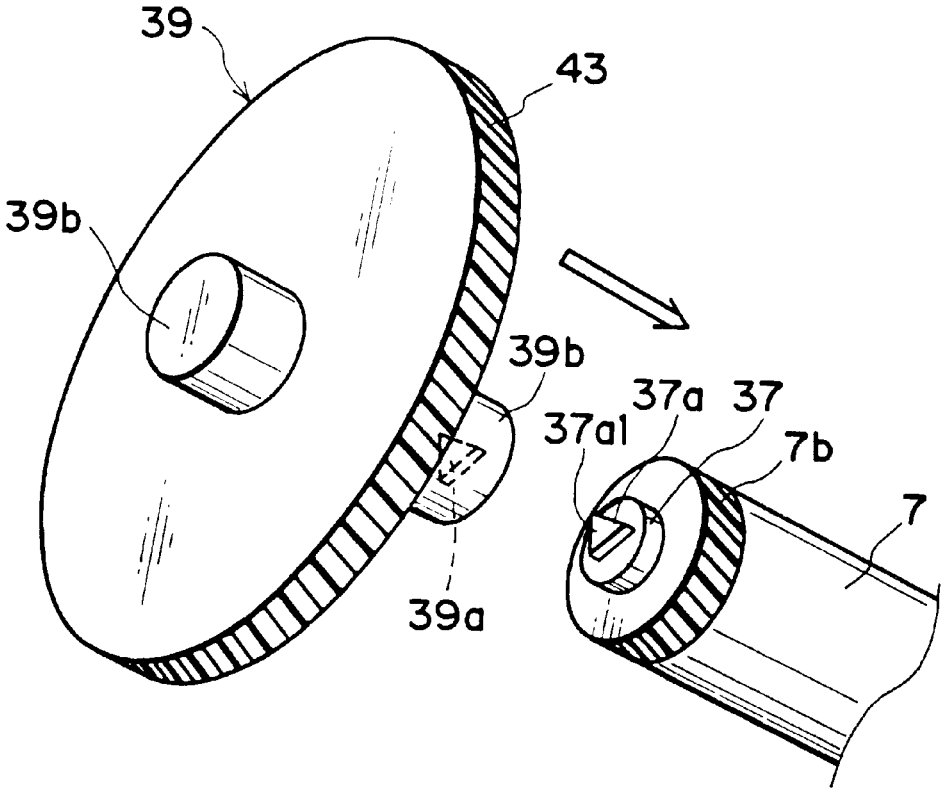
FIG. 14 is a perspective view of the coupling means on the process cartridge side, and the coupling means on the image forming apparatus main assembly side.
Figure 16:
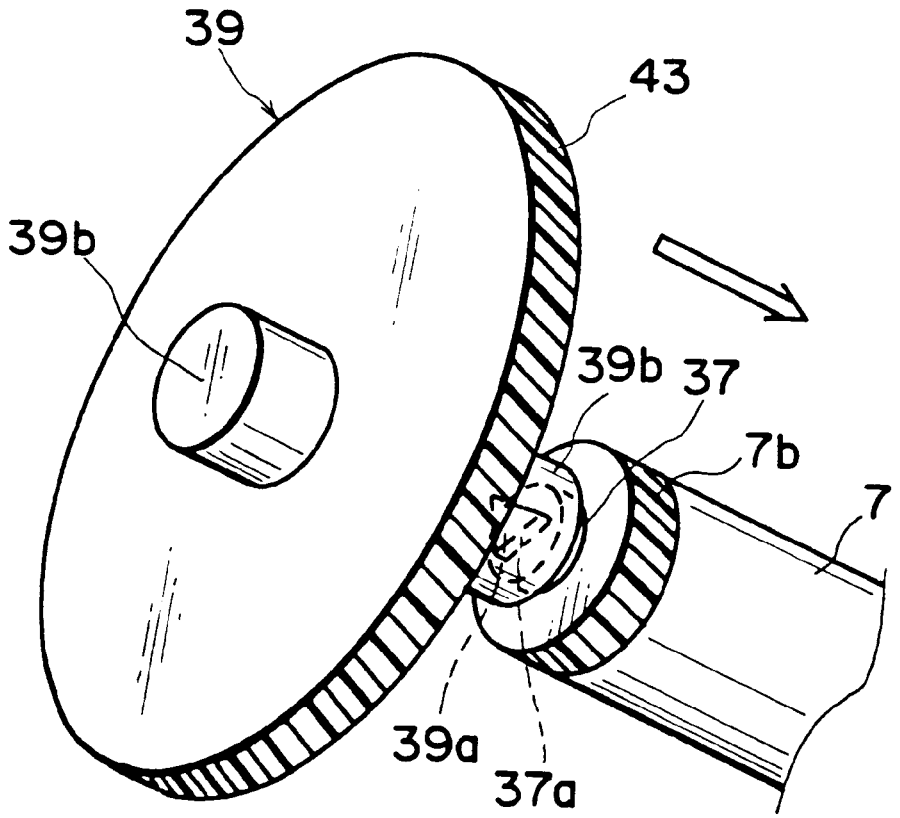
FIG. 16 is a perspective view of the coupling means on the process cartridge side, and the coupling means on the image forming apparatus main assembly side.

The image forming apparatus main assembly A is also provided with a coupling means, which is constituted of the female coupler shaft 39*b* (cylindrical). The female coupler shaft 39*b* is positioned so that its axial line aligned with the axial line of the photosensitive member 7 after the process cartridge B is mounted in the image forming apparatus main assembly A (FIG. 13 and FIG. 14). Referring to FIG. 13, the female coupler shaft 39*b* is a driving shaft integral with a large gear 43. The female coupler shaft 39*b* and the large gear 43 constitute a driving force transmission member 39; the female coupler shaft 39*b* projects from the side wall of the large gear 39*b*, in alignment with the rotational axis of the large gear 43 (FIG. 14 and FIG. 16). In this embodiment, the large gear 43 and the female coupler shaft 39*b* are molded in a single piece.

The large gear 43 on the image forming apparatus main assembly A side is a spur gear, which meshes with a small gear 62, which is fixed to, or integral with, the shaft 61*a* of a motor 61. The large gear 43 has helical teeth angled to generate such thrust that works in the direction to move the female coupler shaft 39*b* toward the male coupler shaft 37 as the driving force is transmitted to the large gear 43 from the small gear 62. With this arrangement, as the motor 61 is turned on to form an image, the female coupler shaft 39*b* with the coupling hole 39*a* is moved toward the male coupler shaft 37 with the coupling projection 37*a* by the aforementioned thrust. As a result, the coupling hole 39*a* and coupling projection 37*a* engage with each other. The coupling hole 39*a* is in the end surface of the female coupler shaft 39*b*, being positioned so that the axial line of the coupling hole 39*a* aligns with that of the female coupler shaft 39*b*.

In this embodiment, the driving force is directly transmitted to the large gear 43 from the small gear 62 fixed to, or integral with, the motor shaft 61*a*. However, the driving force may be transmitted with the use of other means: a gear train which reduces the rotational velocity while transmitting the driving force, a belt and pulley combination, a pair of frictional rollers, a timing belt and pulley combination, or the like.

Figure 17:
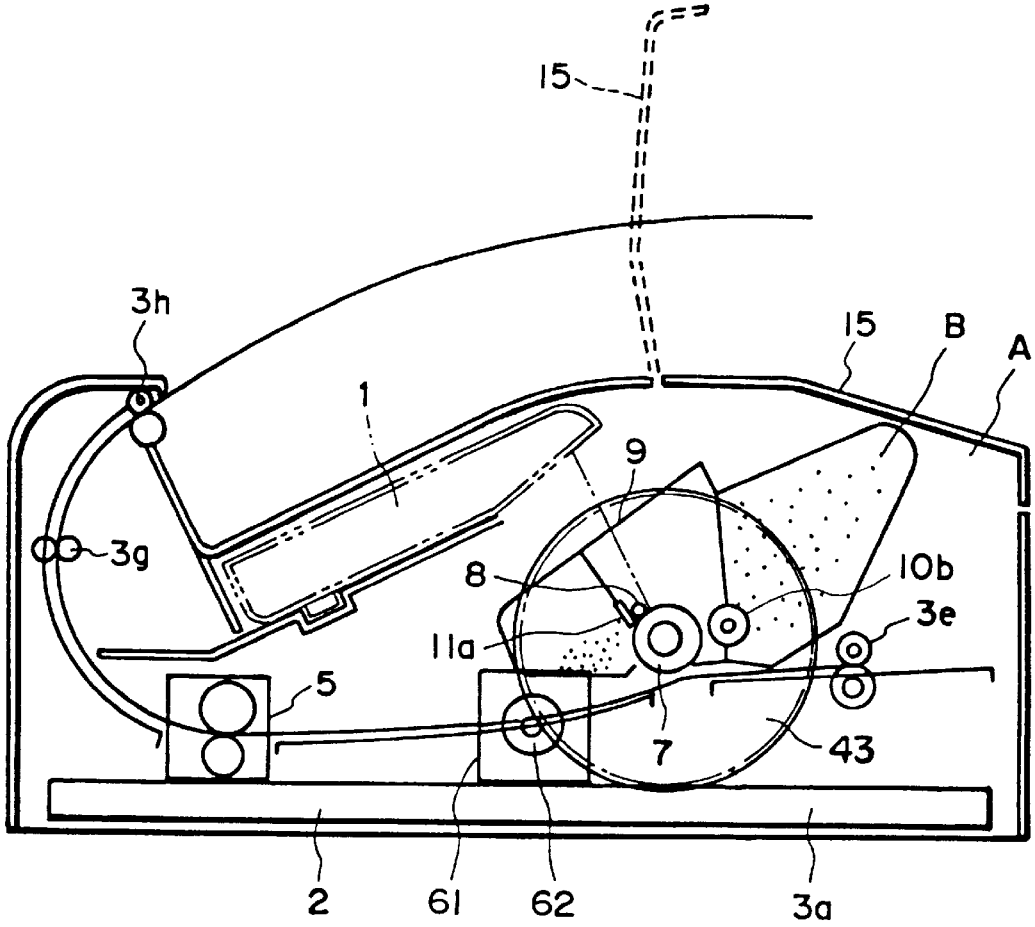
FIG. 17 is a schematic section of the main assembly of an image forming apparatus, which illustrates the driving system of the apparatus.

Next, referring to FIG. 17, FIG. 18 and FIG. 19, the structure for causing the coupling hole 39*a* and the coupling projection 37*a* to engage with each other in connection with the closing of the cover 15 will be described.

Figure 19:
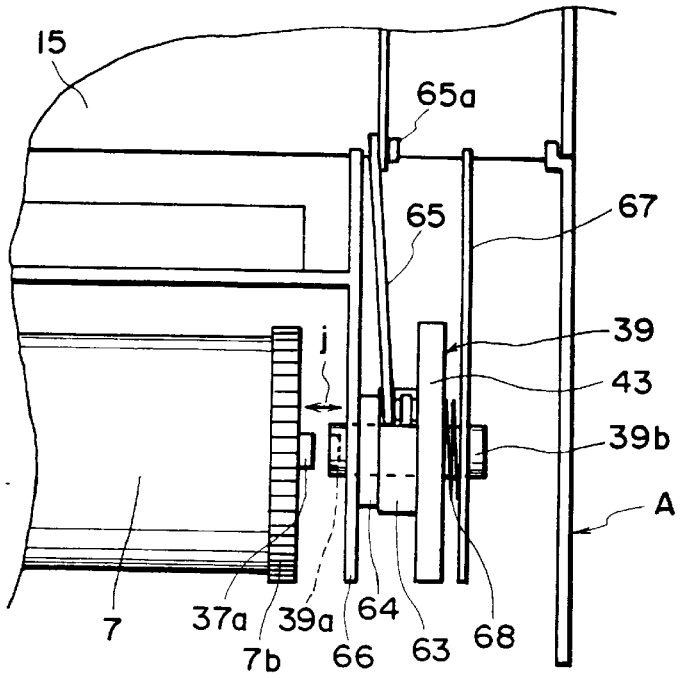
FIG. 19 is a front view of the coupling means portion of the main assembly of the image forming apparatus, and the adjacencies thereof, and depicts their movements during the mounting and removal of the process cartridge.

Referring to FIG. 19, the image forming apparatus main assembly A is provided with side plates 66 and 67, between which the driving force transmission member 63 is disposed. More specifically, the female coupler shaft 39*b*, which is integral with the large gear 43, and also is in alignment with the large gear 43, is rotatively supported by the side plates 66 and 67. In the tight gap between the large gear 43 and the side plate 66, an outer cam 63 and an inner cam 64 are disposed. The inner cam 64 is fixed to the side plate 66, and the outer cam 63 is rotatively fitted around the female coupler shaft 39*b*. The outer cam 63 and the inner cam 64 are threaded on the internal surface and the peripheral surface, respectively, so that the outer cam 63 fits over the inner cam 64, like a nut and a bolt, as it is rotated about the female coupler shaft 39*b*.

Between the large gear 43 and the side plate 67, a compression coil spring 68 is disposed, which is fitted around the female coupler shaft 39*b*, being compressed by the large gear 43 and the side plate 67.

Figure 18:
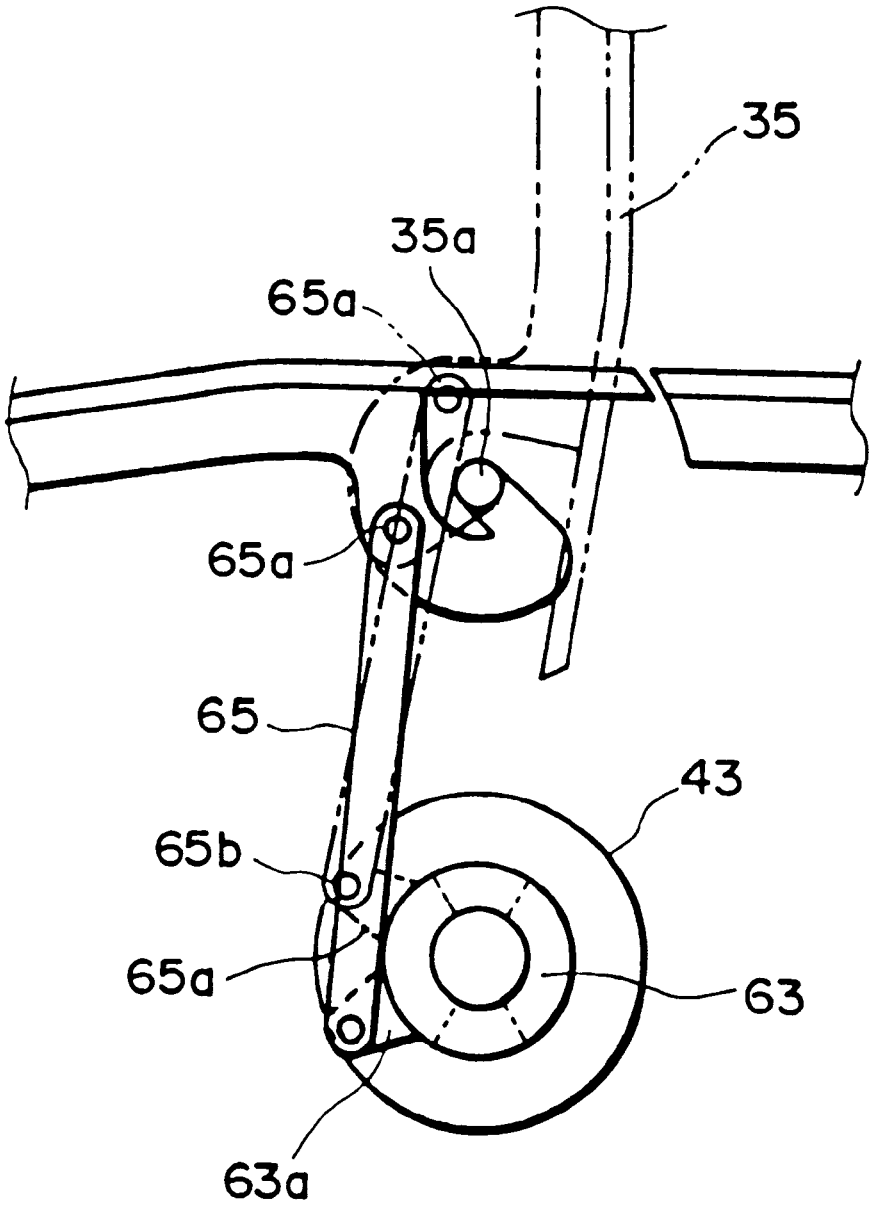
FIG. 18 is a vertical section of the cover and coupling means portion of the main assembly of the image forming apparatus, and depicts their structures.

Referring to FIG. 18, the outer cam 63 is provided with an arm 63*a*, which extends in the radius direction of the outer cam 63 from the peripheral surface of the arm 63*a*. The end portion of this arm 63*a* is connected to the cover 15, with the use of a link 65. More specifically, one end of the link 65 is attached to the cover 15, with the use of a pin 65*a*, at a point on the side opposite to the opening end, that is, a point which will be positioned diagonally downward, on the left-hand side, relative to the rotational axis of the cover 15, in FIG. 18, as the cover is closed, whereas the other end of the link 65 is connected to the end portion of the arm 63*a*, with the use of a pin 65*b*.

Figure 20:
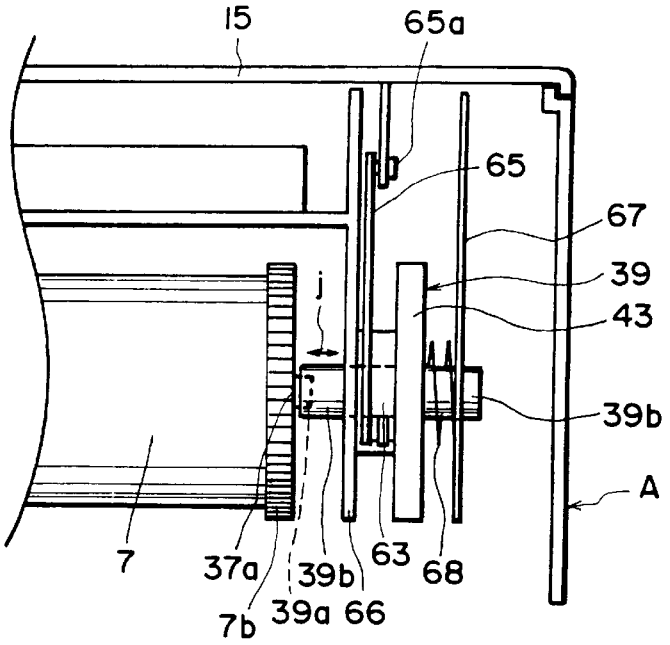
FIG. 20 is a front view of the coupling means portion of the main assembly of the image forming apparatus, and the adjacencies thereof, and depicts their movements during the mounting and removal of the process cartridge.
Figure 21:
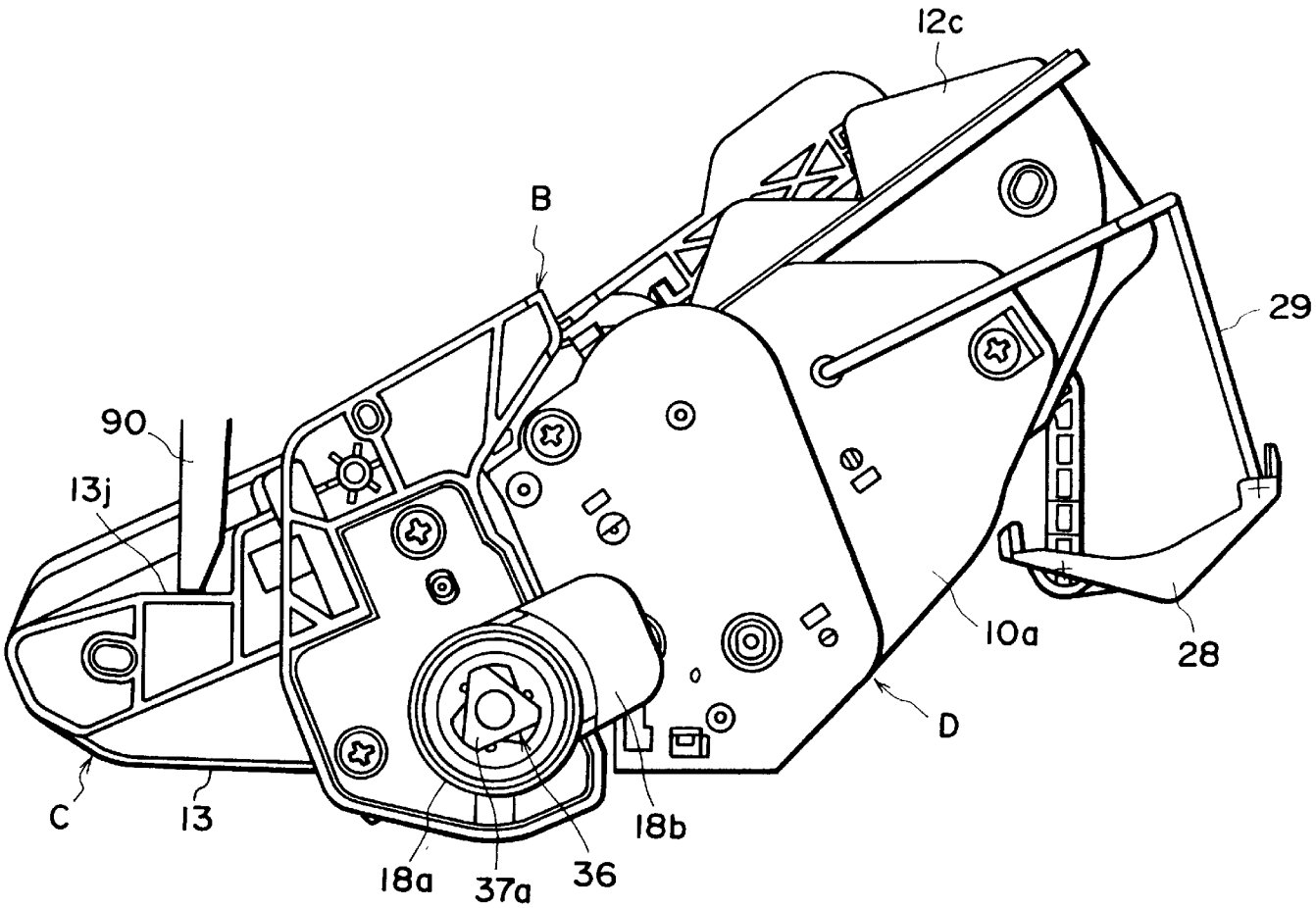
FIG. 21 is a left-hand lateral view (driving side) of the process cartridge.

FIG. 20 is a view of the same portions as those illustrated in FIG. 18, as seen from the right-hand side of FIG. 18. With the cover 15 closed, the link 65, the outer cam 63, and the like, are positioned as illustrated. In other words, the coupling projection 37*a* is in the coupling hole 39*a*, enabling the driving force to be transmitted from the large gear 43 to the photosensitive member 7. Then, as the cover 15 is opened, the pin 65*a* is rotated upward about the shaft 15*a*, pulling up the link 65, which in turn rotates the outer cam 63. As the outer cam 63 its rotated, is threaded internal surface slides on the threaded peripheral surface of the inner cam 64, and therefore, the cam 63 is moved outward of the cartridge space S, forcing the large gear 43 to move away from the cartridge space S, while compressing the compression coil spring 68 disposed between the side plate 67 and the large gear 43. As a result, the coupling projection 37*a* comes out of the coupling hole 39*b*, that is, the female coupler shaft 39*b* is disengaged from the male coupler shaft 37, enabling the process cartridge B to be mounted or removed.

On the contrary, as the cover 15 is closed, the pin 65*a*, which is connecting the cover 15 and the link 65, is rotated downward about the shaft 15*a*, moving the link 65 downward. As the link 65 is moved downward, it pushes down the arm 63*a*, which in turn rotates the outer cam 63 in the reverse direction. As the outer cam 63 is rotated in reverse, it moves away toward the cartridge space S, allowing the large gear 43 to be pushed leftward by the compression coil spring 68 from the position in FIG. 19 to the position in FIG. 20. As a result, the coupling projection 37*a* is placed in the coupling hole 39*a*, enabling the driving force to be transmitted. With the provision of the above described structure, the opening of the cover 15 makes it possible for the process cartridge B to be mounted into, or removed from, the image forming apparatus main assembly A, and the closing of the cover 15 after the mounting of the process cartridge B in the image forming apparatus main assembly A makes it possible for the driving force to be transmitted to the process cartridge B. It should be noted here that sometimes the contact between the end surface of the projection 37*a* and the end surface of the coupler projection 39*b* prevents the coupling projection 37*a* from immediately entering the coupling hole 39*a* after the leftward movement of the large gear 43 from the position in FIG. 19, which is caused by the reverse rotation of the outer cam 63, which is caused by the closing of the cover 15. Even in such a situation, however, as soon as the image forming apparatus main assembly A is turned on, the coupling projection 37*a* enters the coupling hole 39*a*, engaging the female coupler shaft 39*b* and the male coupler shaft 37.

As described above, in this embodiment, in order to mount the process cartridge B into the image forming apparatus main assembly A, or remove the process cartridge B from the image forming apparatus main assembly A, first, the cover 15 is opened. In connection with the opening or closing movement of the cover 15, the female coupler shaft 39*b* with the coupling hole 39*a* moves in the horizontal direction (direction indicated by an arrow mark j). Therefore, while the process cartridge B is mounted into, or removed from, the image forming apparatus main assembly A, the coupling projection 37*a* on the process cartridge B side does not enter the coupling holes 39*a* on the image forming apparatus main assembly A side; the former is not in the latter. Thus, the process cartridge B can be smoothly mounted into, or removed from, the image forming apparatus main assembly A. Also in this embodiment, the large gear 43 under the pressure from the compression coil spring 68, and therefore, the female coupler shaft 39*b* with the coupling hole 39*a* is under pressure which pushes the female coupler shaft 39*b* with the coupling hole 39*a* toward the process cartridge B. Thus, even if the coupling projection 37*a* collides with the end surface of the coupler surface 39*b*, and fails to immediately enter the coupler coupling hole 39*a* after the closing of the cover 15, the coupling projection 37*a* instantly enters the coupling hole 39*a*, engaging the male coupler shaft 37 and the female coupler shaft 39*b*, the moment the motor 61 is started and rotates the female coupler shaft 39*b* with the coupling hole 39*a* after the mounting of the process cartridge B into the image forming apparatus main assembly A.

Next, the shapes of the actual engaging portions of the engaging means, that is, the shapes of the coupling projection 37*a* and the coupling hole 39*a*, will be described.

The female coupler shaft 39*b* is mounted in the image forming apparatus main assembly A so that it is allowed to move in its axial direction, but not in its radial direction. On the other hand, the process cartridge B is mounted in the image forming apparatus main assembly A so that it is allowed to move in its axial direction as well as in the cartridge mounting direction X (FIG. 8). It should be noted here that the movement allowed for the process cartridge B after the correct mounting of the process cartridge B in the image forming apparatus main assembly A is limited to a very small range in the direction along the guide rails 16R and 16L (FIG. 6 and FIG. 7) provided in the cartridge space S.

In other words, as the process cartridge B is mounted into the image forming apparatus main assembly A, the cylindrical guide 13*a*R (FIG. 13), which is integral with a flange 29 attached to the cleaning means frame 13, at the longitudinal end, on the side opposite to where the driving force is transmitted to the process cartridge B, drops into the positioning groove 16*c* (FIG. 6) of the image forming apparatus main assembly A, fitting into it with virtually no gap. Therefore, the cylindrical guide 13*a*R is precisely positioned in the image forming apparatus main assembly A, and the spur gear 7*n* fixed to the photosensitive member 7 meshes with a gear (unillustrated) for transmitting the driving force to the transfer roller 4. On the other end (driven side) of the photosensitive member 7, the cylindrical guide 18*a* of the cleaning means frame 13 is supported by the positioning groove 16*d* of the image forming apparatus main assembly A (FIG. 7).

As the cylindrical guide 18*a* is supported by the positioning groove 16*d* of the image forming apparatus main assembly A, the drum shaft 7*a* and the female coupler shaft 39*b* are aligned with each other with a margin of error of no more than 2.00 mm in terms of concentricity. In other words, the first stage of aligning the coupling members is completed.

Then, as the cover 15 is closed, the female coupler shaft 39*b* with the coupling shaft 39*a* is horizontally moved, fitting around the coupling projection 37*a* (FIG. 20).

Next, how the process cartridge B is positioned relative to the image forming apparatus main assembly A, on the driving side, and how the driving force is transmitted, will be described.

First, as the driving motor 61 of the image forming apparatus main assembly A rotates, the female coupler shaft 39*b* moves toward the male coupler shaft 37. As soon as the phases of the coupling projection 37*a* and the coupling hole 39*a* synchronize, the coupling projection 37*a* and the coupling hole 39*a* engage (in this embodiment, the cross sections of the coupling projection 37*a* and the coupling hole 39*a* are approximately equilaterally triangular, and therefore, their phases synchronize every 120 degrees, allowing the former to enter the latter), and the rotational driving force begins to be transmitted from the image forming apparatus main assembly A to the process cartridge B (the state of the coupling means changes from the one illustrated in FIG. 19 to the one illustrated in FIG. 20).

The cross sections (in the form of an approximately equilaterally triangle) of the coupling projection 37*a* and the coupling hole 39*a* are different in size. In other words, the size of the approximately equilaterally triangular cross section of the coupling hole 39*a* is greater than that of the coupling projection 37*a*. Therefore, the coupling projection 37*a* is allowed to smoothly enter the coupling hole 39*a*, leaving some room to spare.

However, if the size of the cross section of the coupling projection 37*a* is reduced to increase the gap between the wall of the coupling hole 39*a* and the coupling projection 37*a:*

(1) the torsional rigidity of the coupling is reduced, and (2) the distance from the rotational axis of the male coupler shaft 37 to the points at which the ridges of the projection 37*a* make contact with the walls of the coupling hole 39*a*, in the radius direction of the male coupler shaft 37, is also reduced, and therefore, the coupling projection 37*a* is subjected to a greater rotational torque, at the points of contact. In other words, an attempt to provide a large gap between the coupling projection 37*a* and the walls of the coupling hole 39*a* so that the coupling projection 37*a* smoothly enters the coupling hole 39*a* may result in the reduction in the torsional rigidity of the coupling means, which in turn results an in anomaly in the produced images.

Therefore, in this embodiment, in consideration of the necessary torsional rigidity for the coupling means, the smallest value for the diameter of the inscribed circle of the coupling projection 37*a* is set at 8.0 mm, and the diameter of the inscribed circle of the coupling hole 39*a* is set at 8.5 mm, providing a gap of 0.5 mm.

In order to make the coupling projection 37*a* smoothly enter the coupling hole 39*a* when the gap afforded between them is small, the superior concentricity must be maintained between the two prior to their engagement.

Therefore, in this embodiment, in order to maintain a concentricity of 1.0 mm between the coupling projection 37*a* and the coupling hole 39*a*, which is necessary for the coupling projection 37*a* to be allowed to smoothly enter the coupling hole 39*a*, the distance by which the cylindrical projection 38*a* of the aforementioned bearing 38 projects relative to the cleaning means frame 13 is rendered greater than the distance by which the coupling projection 37*a* projects relative to the cleaning means frame 13 (FIG. 13), and also, the internal peripheral wall of the cylindrical projection 38*a* is provided with three or more guides 13*a*L4, which project inward from the wall, to guide the female coupler shaft 39*b* by its peripheral surface. When this arrangement, the concentricity between the coupling projection 37*a* and the coupling hole 39*a* is maintained at no more than 1.0 mm prior to the engagement between the two, facilitating the coupling between the two (second stage of alignment).

In an image forming operation, as the female coupler shaft 39*b* rotates, with the coupling projection 37*a* in the coupling hole 39*a*, the three ridges of the coupling projection 37*a* in the form of an approximately equilateral triangular prism make contact with the walls of the coupling hole 39*a*, whereby the driving force is transmitted. During this engagement, the male coupler shaft 37 instantly shifts, and its rotational axial line is instantly aligned with the rotational axial line of the female coupler shaft 39*b*, so that the walls of the coupling hole 39*a* in the form of an approximately equilateral triangular prism, and the ridges of the coupling projection 37*a* also in the form of an approximately equilateral triangular prism, make precise contact with each other.

With the provision of the above structure, while the motor 61 is running, the male coupler shaft 37 and the female coupler shaft 39*b* remain automatically aligned. Further, as the driving force is transmitted to the photosensitive member 7, counter torque is generated in the process cartridge B. This counter torque adds to the pressure by which the rotation control portion 13*i* (FIG. 1, FIG. 2 and FIG. 21) of the top surface of the cleaning means frame 13 of the process cartridge B is pressed upon the rotation control member 90 (FIG. 21) provided on the image forming apparatus main assembly A side, accurately positioning the process cartridge B relative to the image forming apparatus main assembly A.

Since there is a gap between the coupling projection 37*a* and the walls of the coupling hole 39*a*, in terms of the direction perpendicular to the rotational axis of the coupling means, the coupling projection 37*a* is allowed to easily come out of the coupling hole 39*a* while the motor is not running (while an image is not formed). Further, the provision of the above structure stabilizes the contact pressure generated between the coupling projection 37*a* and the walls of the coupling hole 39*a* while the motor 61 is running, and therefore, the coupling means is prevented from rattling or vibrating.

In this embodiment, the coupling projection 37*a* and the coupling hole 39*a* are shaped like a virtually equilateral triangular prism. However, it is obvious that as long as they are shaped like a virtually equilateral polygonal prism, the same effects as those obtained in this embodiment can be obtained. Although giving the coupling projection 37*a* and the coupling hole 39*a* a shape like a virtually equilateral polygonal prism makes the positioning more accurate, the virtually equilateral polygonal prism shape is not mandatory. For example, the coupling projection 37*a* and the coupling hole 39*a* may be in the form of any polygonal prism, as long as the shape given to the coupling projection 37*a* and the coupling hole 39*a* is effective for the female coupler shaft 39*b* to engage with the male coupler shaft 37 and pull it. Further, the coupling projection 37*a* and the female coupler shaft 39*b* may be in the form of a set of a screw and a nut, respectively, with a long pitch; the above described coupling projection 37*a* and coupling hole 39*a* in the form of a virtually equilateral triangular prism may be perceived as a modification of a set of a screw and a nut, respectively, which has three threads.

In comparison to the female coupler shaft 39*b* with the coupling hole 39*a*, the coupling projection 37*a* is more easily damaged, and also inferior in strength. In this embodiment, therefore, the coupling projection 37*a* is placed on the process cartridge B side, which is replaceable, and the female coupler shaft 39*b* with the coupling hole 39*a* is placed on the image forming apparatus main assembly A side, which is required to be highly durable.

V. Grounding of Process Cartridge

The aforementioned photosensitive member 7 was grounded to the image forming apparatus main assembly A on the side opposite to the driven side. In this embodiment, the photosensitive member 7 is grounded on the driven side. In the case of the above described structure, in which the driving force is transmitted to the process cartridge B from the image forming apparatus main assembly A by the coupling means, the rotational axis of which is in alignment with that of the photosensitive member 7, it is difficult to ground the photosensitive member 7, on the driven side. This embodiment is one of the solutions at which the inventors of the present invention arrived in order to effectively ground the photosensitive member 7, on the driven side, in spite of the above described structural difficulty.

Figure 22:
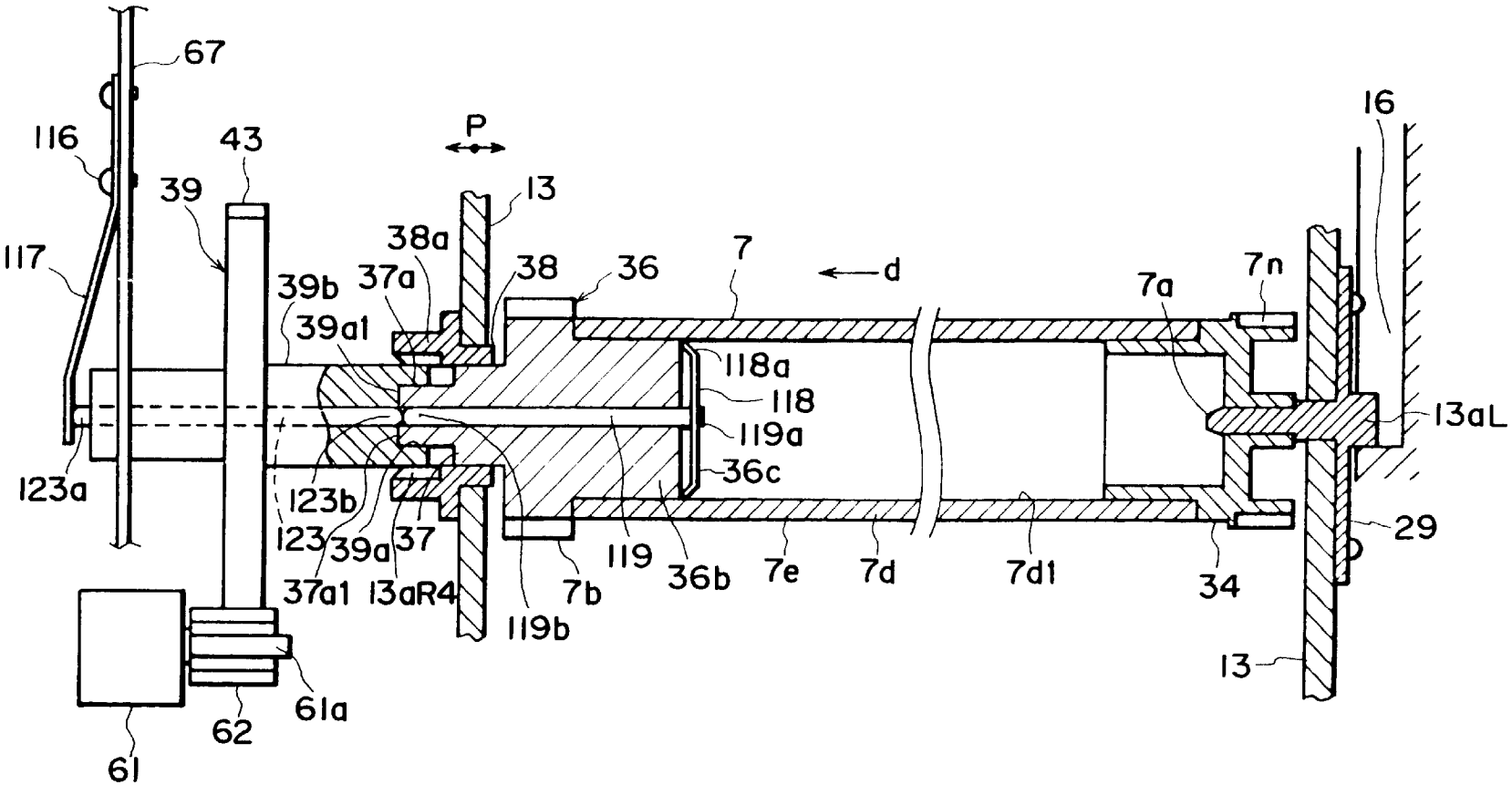
FIG. 22 is a vertical section of the photosensitive drum and the adjacencies thereof, which illustrates the grounding means for the photosensitive drum.

Referring to FIG. 22, the photosensitive member 7 is fitted with the drum flange 34. More specifically, the small diameter portion of the drum flange 34 is fitted in the cylindrical drum base 7*d* of the photosensitive member 7, on the side opposite to the driven side. This drum flange 34 is rotatively supported by a drum axle 7*a*. Since the drum axle 7*a* in this embodiment is not used for grounding, the material for the drum axle 7*a* does not need to be limited to metallic material; it may be synthetic resin, which is electrically nonconductive.

A ground contact electrode 119 as the means for guiding the photosensitive member 7 is fitted in the center hole of the drum flange 36, being allowed to freely shift in its axial direction. The ground contact electrode 119 is in the form of a piece of rod, one end of which is fixed, at a crimping point 119*a,* to the ground plate 118, which is fitted in the cylindrical drum base 7*d,* in contact with the inward end surface 36*c* of the drum flange 36. The ground plate 118 is provided with projections 11*a,* at the periphery, which are slightly bent toward the driven side of the photosensitive drum, biting into the internal surface 7*d*1 of the cylindrical drum base 7*d* due to their elasticity.

Figure 23:
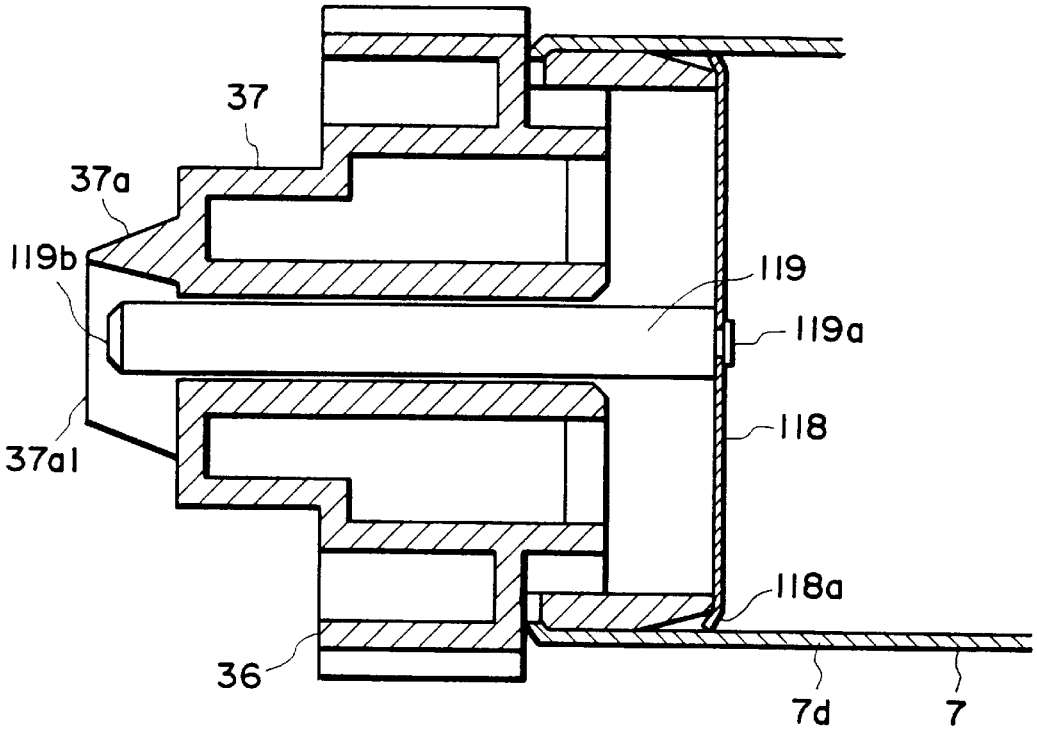
FIG. 23 is a vertical section of the ground contact portion of the photosensitive drum.
Figure 24:
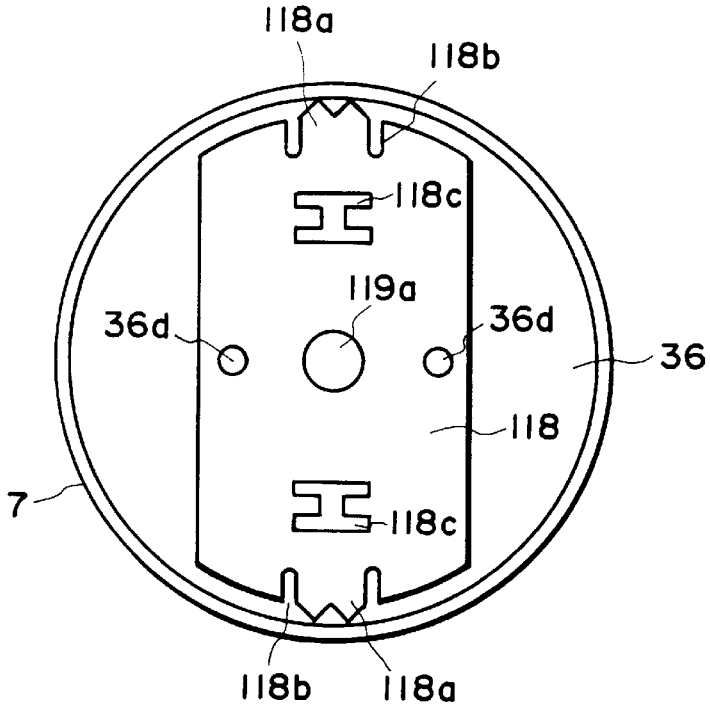
FIG. 24 is a plan view of the ground contact portion of the photosensitive drum.

FIG. 23 is an enlargement of the ground contact electrode 119 and the areas adjacent thereof illustrated in FIG. 22, and illustrates them in detail. FIG. 24 is a plan view of the ground plate 118. Referring to FIG. 24, the ground plate 118 has two parallel straight edges and two opposing, somewhat arc-like, edges. From the arc-like edge, two parallel cuts are made inward, and the projection 118*a* between the two cuts is slightly bent at their bases. A reference character 36*d* designates a dowel which projects from the inward end surface 36*c* of the drum flange 36, and is fitted through the hole of the ground plate 118, preventing the ground plate 118 from rotating relative to the drum flange 36. Between the projection 118*a* and the center hole 119*a* (crimping portion), a hole 118*c* is provided, making the ground plate 118 more flexible around the hole 118*c* than around the center hole 119*a* (crimping portion), so that the ground plate 118 does not flex adjacent to the center hole 119*a* (crimping portion).

The other end 119*b* (contact point) of the ground contact electrode 119 is positioned slightly recessed from the end surface 37*a*1 of the coupling projection 37*a* located at the outward end of the male coupler shaft 37, being therefore protected when the process cartridge B is handled to be mounted into, or removed from, the image forming apparatus main assembly A, or when the process cartridge B is handled outside the image forming apparatus main assembly A.

With the provision of the above arrangement, as the contact point 119*b* is pushed inward in its axial direction, the ground plate 118 is flexed inward of the cylindrical drum base 7*d,* because the ground plate 118 is anchored to the cylindrical drum base 7*d* by its projection 118*a.* In other words, the contact point 119*b* (ground contact electrode 119) is afforded some play in the axial direction.

Figure 25:
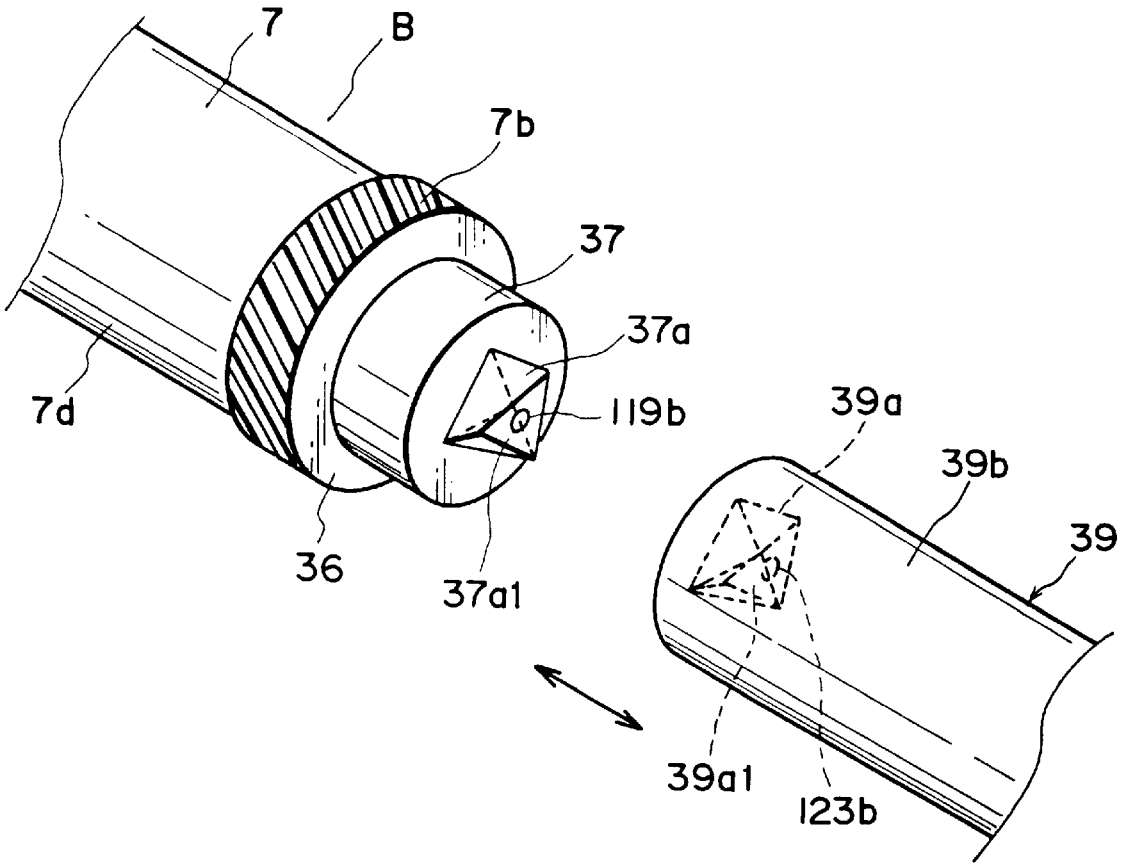
FIG. 25 is a perspective view of the grounding means for the photosensitive drum.

Referring to FIG. 25, the ground contact point 119*b* slightly sticks out from the end surface 37*a*1 of coupling projection 37*a,* at the rotational center of the end surface 37*a*1.

Referring to FIG. 22, as for the ground contact electrode 123 on the image forming apparatus main assembly A side, it is immovably fitted in the center hole of the female coupler shaft 39*b*. One end of the ground contact electrode 123 constitutes the ground contact point 123*b* which makes contact with the ground contact point 119*b* on the process cartridge B side, and the other end of the ground contact electrode 123 constitutes a ground contact point 123*b* which presses upon a plate spring 117 fixed to the steel side plate 67 of the image forming apparatus main assembly A with small screws 116. The ground contact point 123*b* slightly sticks out from the bottom surface 39*a*1 of the coupling hole 39*a,* to simplify maintenance. The plate spring 117 is made of electrically conductive material, for example, spring steel, stainless steel, phosphor bronze, beryllium, bronze, or the like.

The ground contact electrode 119 is also an electrically conductive member, and is formed of phosphor bronze, stainless steel, plated steel, or the like. The ground contact electrode 123 on the image forming apparatus main assembly A side may be formed of the same material as that for the ground contact electrode 119 on the process cartridge B side. However, if the plate spring 117 is formed of spring steel, the sliding contact point 123*a* is desired to be formed of phosphor bronze or beryllium bronze in consideration of resistance to frictional wear.

Referring to FIG. 22, adjacent to the male coupler shaft 37 in terms of its axial direction, the female coupler shaft 39*b* is disposed. As described before, as the cover 15 is closed after the mounting of the process cartridge B into the image forming apparatus main assembly A, the female coupler shaft 39*b* moves toward the coupling projection 37*a* due to the elastic force from the compression coil spring 68 (FIG. 20), fitting around the coupling projection 37*a* of the male coupler shaft 37 (coupling projection 37*a* enters coupling hole 39*a*) immediately, or as soon as the female coupler shaft 39*b* begins to rotate. However, before the bottom surface 39*a*1 of the coupling hole 39*a* comes in contact with the end surface 37*a*1 of the coupling projection 37*a,* the ground contact point 123*b* on the image forming apparatus main assembly A side comes in contact with the ground contact point 119*b* on the process cartridge B side. Then, the female coupler shaft 39*b* is advanced further by the elastic force from the compression coil spring 68 against the elastic force generated by the ground plate 118, and the bottom surface 39*a*1 of the coupling hole 39*a* comes in contact with the end surface 37*a*1 of the coupling projection 37*a.* While the sliding contact point 123*a* moves due to the advancement of the female coupler shaft 39*b,* the plate spring 117 follows the sliding contact point 123*a,* remaining in contact with it, because of its elasticity.

Since the distance the female coupler shaft 39*b* is allowed to advance toward the coupling projection 37*a* is regulated, the contact between the walls of the coupling hole 39*a* and the coupling projection 37*a* generates force in the direction to pull the coupling projection 37*a* into the coupling hole 39*a* as the female coupler shaft 39*b* rotates. This force assures that the bottom surface of the coupling hole 39*a* remains in contact with the end surface 37*a*1 of the coupling projection 37*a,* stabilizing the coupling between the process cartridge B and the image forming apparatus main assembly A. The ground contact electrode 123 rotates with the female coupler shaft 39*b,* and the sliding contact point 123*a* rotationally slides on the plate spring 117. The velocity at which the sliding contact point 123*a* slides on the plate spring 117 is relatively slow, and the sliding keeps both components in the desirable state of contact in terms of electrical conductivity.

As the cover 15 is opened, the female coupler shaft 39*b* moves in the direction to separate from the coupling projection 37*a*. First, the bottom surface 39*a*1 separates from the end surface 37*a*1 of the coupling projection 37*a,* and then, the ground contact electrode 119 is slightly moved by the restitution of the ground plate 118, with the ground contact point 119*b* on the process cartridge B side following the ground contact point 123*b* for a moment. Then, as the female coupler shaft 39*b* is farther moved away from the process cartridge B, the ground contact points 119*b* and 123*b* become separated. The ground contact electrode 123 on the image forming apparatus main assembly A side is retracted together with the female coupler shaft 39*b,* flexing the plate spring 117, with the ground contact point 123*a*. Finally, the female coupler shaft 39*b* is moved away from the process cartridge B far enough for the coupling projection 37*a* to completely come out of the coupling hole 39*a,* that is, the female coupler shaft 39*b* is completely disengaged from the male coupler shaft 37, readying the image forming apparatus main assembly A for the removal or mounting of the process cartridge B.

Figure 26:
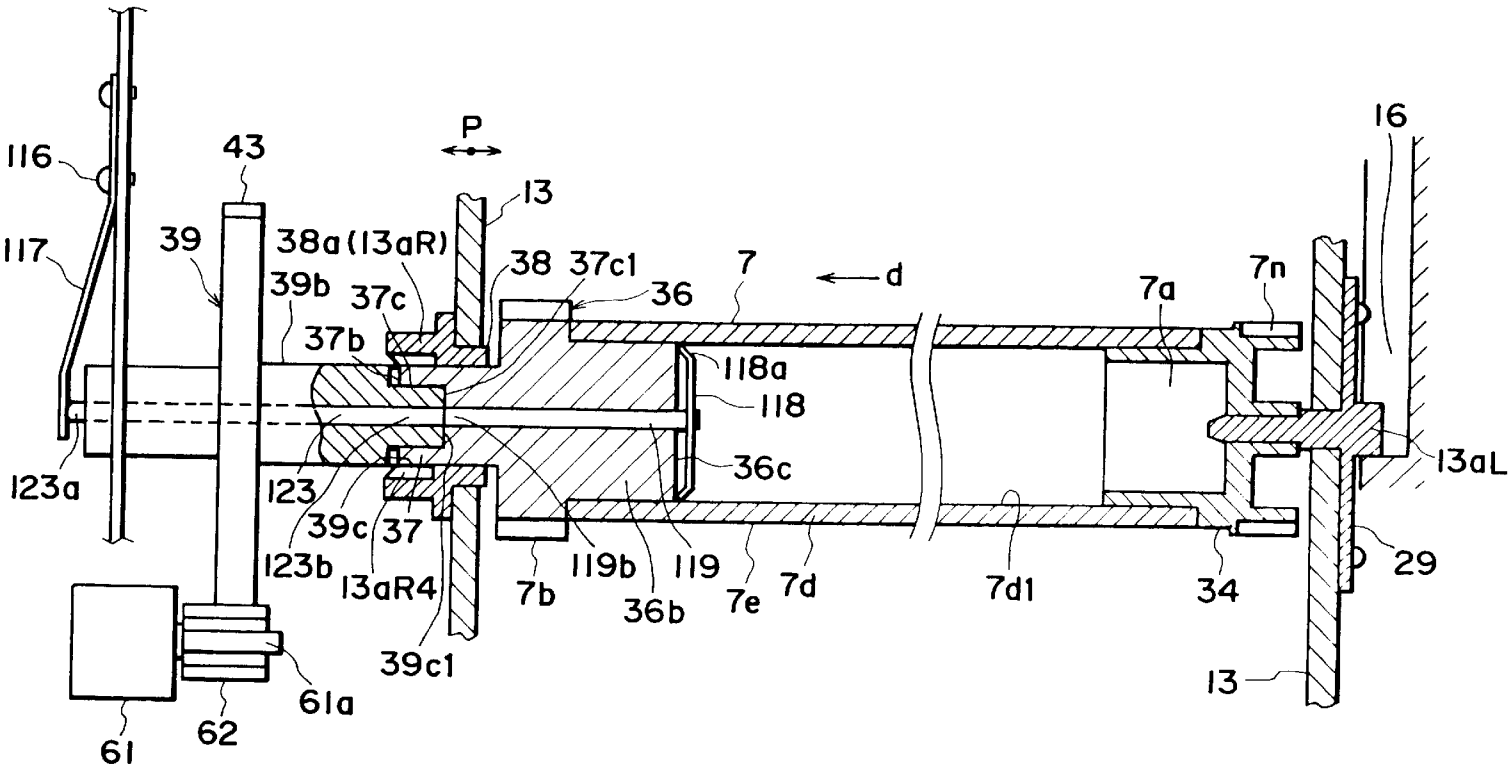
FIG. 26 is a vertical section of the photosensitive drum and the adjacent thereof, which illustrates the grounding means for the photosensitive drum.
Figure 27:
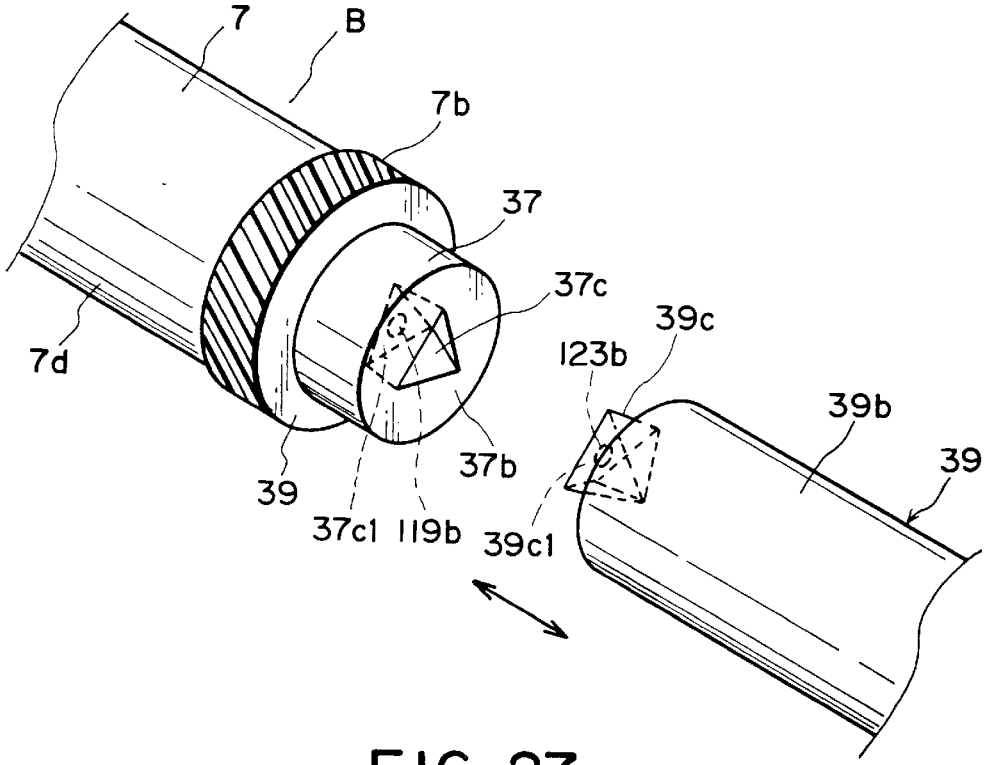
FIG. 27 is a perspective view of the grounding means for the photosensitive drum, which is different from the one illustrated in FIG. 25.

In the above description of the coupling means, the process cartridge B was provided with the male coupler shaft 37 with the coupling projection 37*a,* and the image forming apparatus main assembly A was provided with the female coupler shaft 39*b* with the coupling hole 39*a* in which the coupling projection 37*a* fits. However, the sides on which a coupling projection and a coupling hole are provided may be reversed, as illustrated in FIG. 26 and FIG. 27, in which the male coupler shaft 37 is provided with a coupling hole 37*c,* which is located at the center of the end surface 37*b,* and the female coupler shaft 39*b* is provided with a coupling projection 39*c,* which is located at the center of the end surface.

The coupling hole 37*c* is a twisted hole, and its cross section, perpendicular to its rotational axial line, is approximately equilaterally triangular. The coupling projection 39*c* is in the form of a twisted polygonal prism, more specifically, a virtually equilaterally triangular twisted prism. The coupling hole 37*c* is greater in cross section than the coupling projection 39*c,* just enough so that the ridges of the coupling projection 39*c* can still make contact with the corresponding walls of the coupling hole 37*c* as the coupling projection 39*c* enters the coupling hole 37*c*.

From the center of the end surface 39*a*1 of the coupling projection 39*c,* the ground contact point 123*b* slightly sticks out, and from the bottom surface 37*c*1 of the coupling hole 37*c,* the ground contact point 119*b* on the process cartridge B side slightly sticks out. The ground contact points 119*b* and 123*b* are constituted of the ends of the ground contact electrode 119 on the process cartridge B side, and the grounding member 123 on the image forming apparatus main assembly A side, respectively. Otherwise, this reversal arrangement for the coupling means is the same as the original arrangement illustrated in FIG. 22 and the like drawings. Therefore, the description of the portions other than the male coupler shaft 37 and the female coupler shaft 39*b* in this arrangement will be omitted since they are the same as those for the original arrangement.

VI. Relationship Between Coupling Means and Grounding Means

The above described coupling means was designed so that the driving force was transmitted by the engagement between a coupling shaft with a coupling hole in the form of a twisted polygonal prism and a coupling projection in the form of a twisted polygonal prism which has the same number of sides as the coupling hole. Therefore, as long as the motor 61 is on, the photosensitive member 7 keeps on being pulled in its axial direction by the coupler shaft on the image forming apparatus main assembly A side, which is effective to stabilize the position of the photosensitive member 7, i.e., the position of the process cartridge B, in terms of its longitudinal direction.

On the other hand, in order to keep the ground contact points 119*b* and 123*b* in contact with each other, the compression coil spring 68 is employed, which presses the female coupler shaft 39*b* (the coupling shaft is on the image forming apparatus main assembly A side, or driving side) in the axial direction. Therefore, it is possible to employ a coupling means which does not generate thrust when the motor 61 is on.

Referring to FIG. 25, such a coupling means that does not generate thrust may comprise a coupling projection in the form of a straight polygonal prism (equilateral triangular prism), and a coupling shaft with a coupling hole in the form of a straight polygonal prism (equilateral triangular prism), into which the coupling projection enters. This arrangement can align the coupler shaft on the process cartridge B side and the coupler shaft on the image forming apparatus main assembly side, and also can keep the ground contact point 119*b* pressed upon the ground contact point 123*b,* but does not generate thrust in their axial direction. The sides on which the projection, in the form of a polygonal prism, and the hole, in the form of a polygonal prism, are located may be reversed as illustrated in FIG. 27. Such an arrangement can also align the coupler shaft on the image forming apparatus main assembly A side and the coupler on the process cartridge B side, and keep the ground contact point 119*b* pressed upon the ground contact 123*b*, but does not generate thrust.

In the above description, either both the driving and driven sides of the coupling means are twisted about their rotational axes, or both of these are not twisted. However, process cartridges different in design can be mounted into, or removed from, the same image forming apparatus main assembly A, depending on how a process cartridge B is mounted into, or removed from, the image forming apparatus main assembly A, and how the photosensitive member 7 is mounted in a process cartridge B.

More specifically, even if the image forming apparatus main assembly A is provided with the female coupler shaft 39*b* with a coupling hole 39*a* in the form of a twisted polygonal prism, the coupling projection 37*a* of the male coupler shaft 37 of a process cartridge, which projects from the end surface of the male coupler shaft 37, and is to enter the coupling hole 39*a* on the image forming apparatus main assembly A side to accurately position the process cartridge B relative to the image forming apparatus main assembly A, may be in the form of a straight polygonal prism; for example, such it may be a design that the image forming apparatus main assembly A is provided with an elastic member, which is placed in the compressed state in the cartridge space S, at a location corresponding to one of the longitudinal ends of the mounted process cartridge B, and the photosensitive member 7 is attached to the cleaning means frame 13 immovably in the axial direction.

It is also possible to provide the image forming apparatus main assembly A side with a coupling projection in the form of a twisted polygonal prism, and the process cartridge B side with a coupling hole in the form of a straight polygonal prism, into which the coupling projection enters.

VII. Electrical Contact Electrodes Other Than Drum Grounding Contact Electrode

Next, electrical contact electrodes other than the drum grounding contact electrodes will be described.

Figure 28:
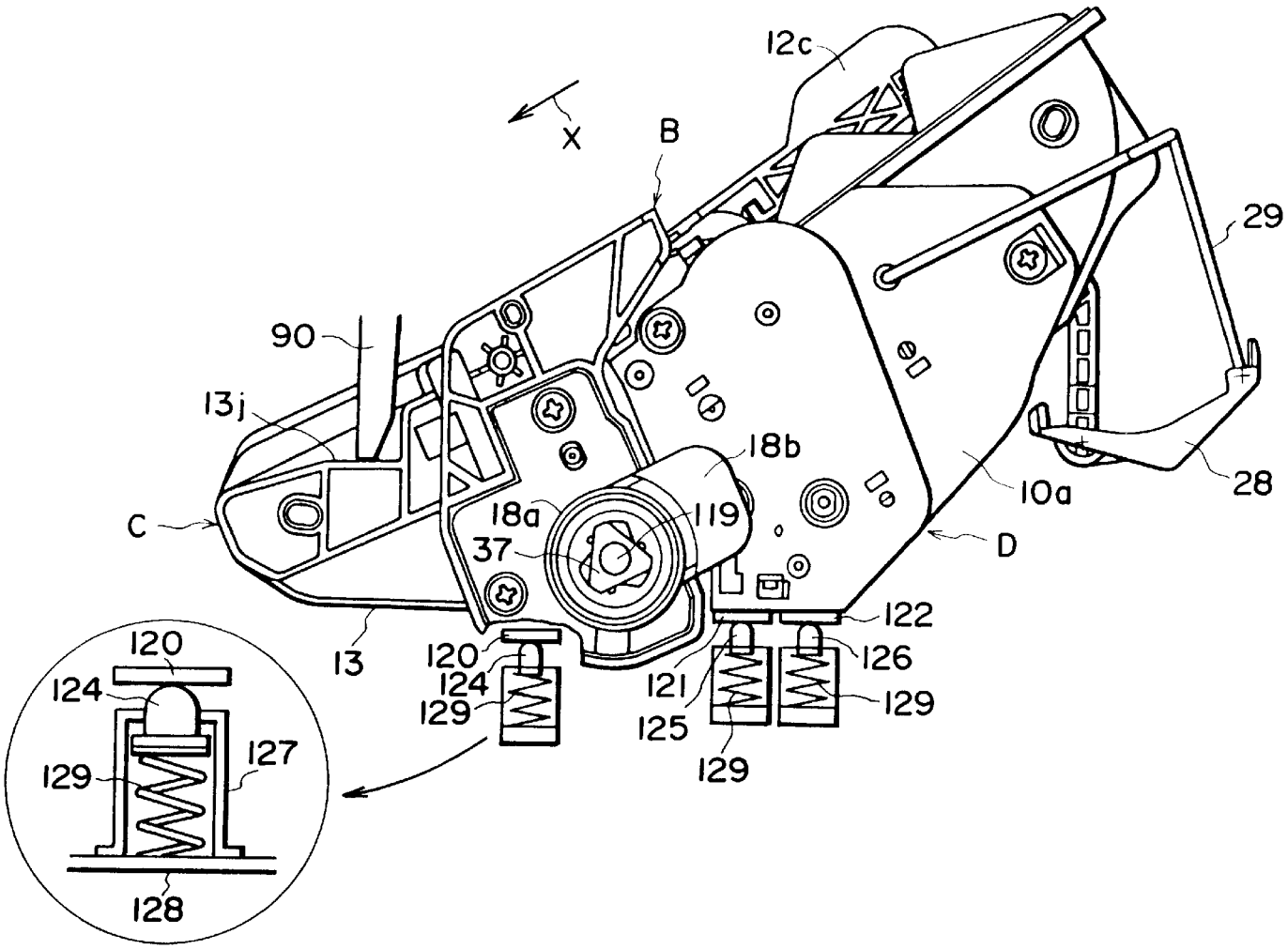
FIG. 28 is a left-hand lateral view (driven side) of the process cartridge, and the areas adjacent thereof, which illustrates the charge bias contact electrode, the development bias contact electrode, the remaining toner amount detection contact electrode, and the corresponding contact electrodes on the apparatus main assembly side.

Referring to FIG. 28, the process cartridge B has a plurality of electrical contact points: electrically conductive charge bias contact electrode 120 electrically connected to the charge roller axis (unillustrated) to apply charge bias to the charge roller 8 illustrated in FIG. 4 from the image forming apparatus main assembly A; electrically conductive development bias contact electrode 121 electrically connected to the development roller 10*d* to apply development bias to the development roller 10*d* from the image forming apparatus main assembly A; and electrically conductive remaining toner amount detection contact electrode 122 electrically connected to a rod antenna 10*g* to detect the remaining amount of the toner. These three contact electrodes 120 to 122 are attached to the process cartridge B so that they all are exposed at the bottom surface of the cartridge frame, on the left-hand side as seen from behind in terms of the direction in which the process cartridge B is inserted. They are separated from each other by distances sufficient to prevent electrical leakage among them. The charge bias contact 120 is attached to the cleaning unit C, whereas the development bias contact electrode 121 and the remaining toner amount detection contact electrode 122 are attached to the development unit D. Further, the remaining toner amount detection contact electrode 122 doubles as a process cartridge detection contact electrode that enables the image forming apparatus main assembly A to detect whether the process cartridge B has been mounted in the image forming apparatus main assembly A or not.

These three contact electrodes are formed of approximately 0.1 mm to 0.3 mm thick electrically conductive metallic plate (for example, stainless steel or phosphor bronze). Their portions which are not exposed from the process cartridge B are elaborately routed within the process cartridge B. The charge bias contact electrode 120 is exposed from the cleaning unit C, from the bottom, at the longitudinal end on the driven side, whereas the development bias contact electrode 121 and the remaining toner amount detection contact electrode 122 are exposed from the development unit D, from the bottom, at the longitudinal end on the driven side.

Next, the connection between the contact electrodes provided on the process cartridge B side, and the contact electrode on the image forming apparatus main assembly A side, will be described.

Referring to FIG. 7, the image forming apparatus main assembly A is provided with three contact electrodes 124, 125 and 126 which make contact with the corresponding electrical contact electrodes 120 to 122 on the process cartridge B side as the process cartridge B is mounted in the image forming apparatus main assembly A. These three contact electrodes on the image forming apparatus main assembly A side are located in the cartridge space S of the image forming apparatus main assembly A, on the bottom wall, on the driving side (obviously, the charge bias contact electrode 124 makes electrical contact with the charge bias contact electrode 120; the development bias contact electrode 125, with the development bias contact electrode 121; and the remaining toner amount detection contact electrode 126 makes electrical contact with the remaining toner amount detection contact electrode 122).

Also referring to FIG. 7, the development bias contact electrode 125, the remaining toner amount detection contact electrode 126, and the charge bias contact electrode 124 are located below the guide rail 16, that is, outside the space between the guide rail 16 and the guide member 17, and project upward by a predetermined distance from the bottom wall of the cartridge space S, right next to the wall to which the guide rail 16 belongs. Further, these three contact electrodes 124, 125 and 126 on the image forming apparatus main assembly A side are elastically supported.

At this point in time, the positional relationship among the contact electrodes 120, 121 and 122 on the process cartridge B side, the cylindrical guide 18*a*, and the rotation control guide 18*b*, will be described.

Referring to FIG. 28, in which the process cartridge B is more or less horizontal, the remaining toner amount detection contact electrode 122 is on the right-hand side, and the development bias contact electrode 121 is in the middle. The charge bias contact electrode 120 is on the left-hand side. At about the same level slight above the contact electrodes 120, 121 and 122, the rotation control guide 18*b* and the cylindrical guide 18*a* are located. In terms of the direction X in which the process cartridge B is inserted, the remaining toner amount detection contact electrode 122 is on the most downstream side, and the rotation control guide 18*b* and the development bias contact electrode 121 are on the upstream side of the remaining toner amount detection contact electrode 122. Then, the cylindrical guide 18*a* (ground contact electrode 119) is on the upstream side of the development bias contact electrode 121, and the charge bias contact electrode 120 is on the upstream side of the cylindrical guide 18*a*. With the above described arrangement, the charge bias contact electrode 120 is close to the charge roller 8, and the development bias contact electrode 121 is close to the development roller 10*d*. Also, the remaining toner amount detection contact electrode 122 is close to the rod antenna 10*g*. In other words, the above described positioning of the electrical contact electrodes minimizes the otherwise long routing of the contacts in the process cartridge B as well as image forming apparatus main assembly A.

The sizes of the contact electrodes and the contact points are as follows. First, the charge bias contact electrode 120 is approximately 10.0 mm in both its vertical and horizontal lengths, and the development bias contact electrode 121 is approximately 6.5 mm in vertical length and approximately 7.5 mm in horizontal length. The remaining toner amount detection contact electrode 122 is 2 mm in diameter, and approximately 18.0 mm in horizontal length. As for the shapes of the charge bias contact electrode 120, the development bias contact electrode 121, and the remaining toner amount detection contact electrode 122, they are all rectangular.

On the other hand, the three contact electrodes 124, 125 and 126 on the image forming apparatus main assembly A side are located below the guide rail 16, adjacent to the wall to which the guide rail 16 belongs. They project upward by a predetermined distance from their own holders 127, in which they are elastically supported by a compression oil spring 129. Next, more details of the contact electrode 124, 125 and 126, and their adjacent areas will be described with reference to the contact charge bias contact electrode 124. Referring to FIG. 28 in which the charge bias contact electrode 124 is illustrated in enlargement, the charge bias contact electrode 124 is fitted in the holder 127 fixed to an electrical circuit board 128. The electrical circuit board is attached to the image forming apparatus main assembly A. In the holder 127, the electrically conductive compression coil spring 119 is disposed between the contact electrode 124 and the electrical circuit on the circuit board, so that the contact electrode 124 is electrically connected to the electrical circuit on the circuit board 128, and at the same time, is elastically projected upward by a predetermined distance from the hole at the top of the holder 127.

Until the process cartridge B is inserted into the image forming apparatus main assembly A, to a certain point along the guide rails 16, the contact electrodes 124 to 126 on the image forming apparatus main assembly A side remain projecting from the top of the holders 127 due to the elastic force of the compression coil spring 129. In other words, until the process cartridge B reaches that certain point along the guide rails 16, no contact is made between the contact electrodes 124 to 126 on the image forming apparatus main assembly A side, and the contact electrodes 120 to 122 on the process cartridge B side. As the process cartridge B is inserted further beyond that certain point, the contact electrodes 120 to 122 on the process cartridge B side make contact with the corresponding contact electrodes 124 to 126 on the image forming apparatus main assembly A side. Then, as the process cartridge B is slightly advanced from the point at which electrical contact has been made between the image forming apparatus main assembly A and the process cartridge B, the cylindrical guides 18*a* of the process cartridge B drop into the positioning grooves 16*d*, causing the contact electrodes 120 to 122 on the process cartridge B side to push down the corresponding contact electrodes 124 to 126 on the image forming apparatus main assembly A into the holders 127 against the elastic force from the compression coil springs 129, increasing thereby the contact pressure between the correspondent contact electrodes.

As is evident from the above description, this embodiment assures that as the process cartridge B is inserted into the image forming apparatus main assembly A to a predetermined point along the guide rail 16, the contact electrode 120 to 122 make contact with the corresponding contact electrodes 124 to 126.

As the charge bias contact electrode 120 makes contact with the charge bias contact electrode 124, the former is electrically connected to the latter, and high voltage (compound voltage composed of AC voltage and DC voltage) is applied to the charge roller 8. As the development bias contact electrode 121 makes contact with the development bias contact electrode 125, the former is electrically connected to the latter, and high voltage is applied to the development roller 10*d*. Also, as the remaining toner amount detection contact electrode 122 makes contact with the remaining toner amount detection contact electrode 126, the former is electrically connected to the latter, and information, which reflects the electrostatic capacity between the rod antenna 10*g* and the development roller 10*d*, is transmitted to the image forming apparatus main assembly A.

Since the contact electrode 120 to 122 on the process cartridge B side are located on the bottom side of the process cartridge B, the state of contact between them and the corresponding contact electrodes 124 to 126 on the image forming apparatus main assembly A side is immune to the positional accuracy of the process cartridge B relative to the image forming apparatus main assembly A in terms of the direction perpendicular to the direction X in which the process cartridge B is inserted into the image forming apparatus main assembly A.

The contact electrodes 120 to 122 on the process cartridge B side are all positioned on the same side (driven side) of the cartridge frame. Therefore, the mechanical components of the image forming apparatus main assembly A are positioned on one side of the cartridge space S in terms of the direction perpendicular to the direction X in which the process cartridge B is inserted into the image forming apparatus main assembly A, whereas the electrical wiring components of the image forming apparatus main assembly A are positioned on the other side of the cartridge space S. Thus, it takes a smaller number of steps to assemble the image forming apparatus main assembly A or the process cartridge B, and also it is easier to check or maintain them.

As the process cartridge B is mounted in the image forming apparatus main assembly A, and is driven, the process cartridge B is remarkably precisely positioned relative to the image forming apparatus main assembly A because of the force generated by the aforementioned coupling means in the direction to pull the process cartridge B toward one of the side wall of the image forming apparatus main assembly A, and also because of the aligning function of the coupling means. Further, the measurement of the process cartridge B in terms of its longitudinal direction is remarkably reduced by disposing all three contact points (charge bias contact electrode 120, development bias contact electrode 121, and remaining toner amount detection contact electrode 122) on the driven side, compared to an arrangement in which they are disposed on the side opposite to the driven side. Therefore, the deviation in the measurement of the process cartridge B in terms of its longitudinal direction, which occurs during the manufacture of the process cartridge B, is reduced.

As is evident from the above description, according to this embodiment, the plurality of electrical contact electrodes (charge bias contact electrode 120, development bias contact electrode 121, and remaining toner amount detection contact electrode 122) on the process cartridge B side are precisely positioned relative to the contact electrodes (charge bias contact electrode 124, development bias contact electrode 125, and remaining toner amount detection contact electrode 126) on the image forming apparatus main assembly A side. In other words, it is assured that a desirable electrical connection is made and maintained between the process cartridge B and the image forming apparatus main assembly A, and therefore, image quality is further improved.

VIII. Miscellaneous Embodiments

The process cartridge B referred to in the preceding description of the embodiments of the present invention was a process cartridge for forming a monochromatic image. However, the application of the present invention is not limited to a monochromatic process cartridge. That is, the present invention is also applicable, with desirable results, to a multi-color process cartridge, which comprises a plurality of developing means, and forms a multicolor image (two color image, three color image, full-color image, or the like).

The choice of the electrophotographic photosensitive member is not limited to the aforementioned photosensitive drum 7. For example, the following may be included. As for the photosensitive material for the photosensitive member, various photoconductive materials may be employed; for example, amorphous silicon, amorphous selenium, zinc oxide, titanium oxide, organic photoconductor, and the like. As for the shape of the base member on which the photosensitive material is borne, it may be in the form of a drum or a belt. For example, in the case of a base member in the form of a drum, photoconductive material is placed by vapor-deposition, or simply painted, on the surface of a piece of aluminum alloy cylinder or the like.

As for the developing method, various known developing methods may be employed: the two component magnetic brush method, the cascade method, the touch-down method, the cloud method, or the like.

As for the charging means, in the preceding embodiments, the so-called contact type charging method is employed. However, the present invention is also compatible with various charging methods other than the aforementioned one. For example, a well known method, according to which a piece of tungsten wire is shielded on three sides with metallic shields formed of aluminum or the like, and the peripheral surface of a photosensitive drum is uniformly charged by transferring the positive or negative ions generated by applying high voltage to the tungsten wire, to the photosensitive drum, may certainly be employed.

As for the shape of the charging means, the charging means may be in the form of a blade, (charging blade), a pad, a block, a rod, a wire, or the like, in addition to the aforementioned roller.

As for the cleaning means for cleaning the photosensitive drum of the toner which remains on the photosensitive member after image transfer, it may be constituted of a blade, a fur brush, a magnetic brush, or the like.

As described above, according to the above described embodiments of the present invention, as the process cartridge B is mounted into the main assembly of an electrophotographic image forming apparatus, the coupler on the process cartridge B side is automatically engaged and aligned with the coupler on the apparatus main assembly side by the rotation of the coupler on the apparatus main assembly side. With this action, the process cartridge is precisely positioned relative to the main assembly of an image forming apparatus. Therefore, it is assured that the drum ground electrode on the process cartridge side is desirably engaged with the drum ground electrode on the apparatus main assembly side. It is also assured that desirable electrical contact is made between the charge bias contact electrode exposed from the downward facing surface of the cartridge frame, adjacent to the coupling means, the development bias contact electrode, the remaining toner amount detection contact electrode, on the process cartridge side, and the counterparts on the main assembly side of an electrostatic image forming apparatus.

In other words, it is assured that more precise electrical connection is made between the process cartridge side and the main assembly side of an electrophotographic image forming apparatus when a process cartridge is mounted in the main assembly of an electrophotographic image forming apparatus, compared to the conventional structure.

Further, in the case of the electrophotographic image forming apparatus in the above-described embodiments of the present invention, as a process cartridge is inserted into the main assembly of an electrophotographic image forming apparatus, the coupler on the process cartridge side is automatically engaged and aligned with the coupler on the electrophotographic image forming apparatus main assembly side by the rotation of the coupler on the main assembly side. Therefore, the process cartridge is precisely positioned relative to the apparatus main assembly, assuring that a desirable electrical connection is made between the drum ground contact electrode on the apparatus main assembly side, and the drum ground contact electrode on the apparatus main assembly side is reliably engaged with the drum ground contact electrode on he process cartridge side, on the coupling means side. It is also assured that desirable electrical connection is made between the charge bias contact electrode, the development bias contact electrode, and the remaining toner amount detection contact electrode, on the apparatus main assembly side, and the counterparts on the process cartridge side.

Therefore, it is assured that more precise electrical connection is made between the process cartridge side and the main assembly side of an electrophotographic image forming apparatus when the process cartridge is mounted in the main assembly of an electrophotographic image forming apparatus, compared to the conventional structure.

As described above, the present invention assures that a desirable electrical connection is made between a process cartridge and the main assembly of an electrophotographic image forming apparatus when the process cartridge is mounted in the electrophotographic image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, comprising;

a cartridge frame;

an electrophotographic photosensitive drum;

a cartridge coupling member for receiving a driving force for rotating said electrophotographic photosensitive drum from the main assembly of said apparatus when said process cartridge is mounted to the main assembly of said apparatus, wherein said coupling member is provided on one longitudinal end of said electrophotographic photosensitive drum, wherein said cartridge coupling member is disposed on a surface of said cartridge frame facing in a direction crossing a mounting direction of said process cartridge into the apparatus;

a charging member for charging said electrophotographic photosensitive drum;

a developing member for developing a latent image formed on said electrophotographic photosensitive drum;

a charging bias contact for receiving a charging bias to be applied to said charging member from the main assembly of said apparatus when said process cartridge is mounted to the main assembly of said apparatus;

a developing bias contact for receiving a developing bias to be applied to said developing member from the main assembly of said apparatus when said process cartridge is mounted to the main assembly of said apparatus; and a detecting contact for notifying the main assembly of said apparatus that said process cartridge is mounted to the main assembly of said apparatus;

wherein said charging bias contact, said developing bias contact and said detecting contact are provided on a bottom surface, when said process cartridge is mounted to the main assembly of said apparatus, of said cartridge frame adjacent said one longitudinal end of said electrophotogrpahic photosensitive drum, and said charging bias contact, said developing contact and said detecting contact are exposed from said cartridge frame.

2. A process cartridge according to claim 1, wherein said drum grounding contact is exposed through a hole formed in said cartridge coupling member, and wherein said drum grounding contact is effective to electrically ground said electrophotographic photosensitive drum to the main assembly of said apparatus when said process cartridge is mounted on the main assembly of said apparatus.

3. A process cartridge according to claim 2, wherein said drum grounding contact is a free end of a rod-like member which is electrically connected with an inner surface of said electrophotographic photosensitive drum through a grounding plate.

4. A process cartridge according to claim 1, 2 or 3, wherein said cartridge coupling member is in the form of a projection provided coaxially with said electrophotographic photosensitive drum.

5. A process cartridge according to claim 4, wherein said projection is in the form of a twisted prism.

6. A process cartridge according to claim 1, wherein said cartridge frame includes a first cartridge frame and a second cartridge frame, wherein said first cartridge frame supports said electrophotographic photosensitive drum, said charging member and said charging bias contact, and said second cartridge frame supports said developing member, said developing bias contact and said detecting contact to be, and wherein said first cartridge frame and second cartridge frame are pivotable relative to each other.

7. A process cartridge detachably mountable to a main assembly of an electrophotographic image forming apparatus, comprising:

a first cartridge frame;

a second cartridge frame which is pivotable relative to said first cartridge frame;

an electrophotographic photosensitive drum supported on said first cartridge frame;

a projection for receiving a driving force for rotating said electrophotographic photosensitive drum from the main assembly of said apparatus when said process cartridge is mounted to the main assembly of said apparatus, wherein said projection is provided on one longitudinal end of said electrophotographic photosensitive drum coaxially with said electrophotographic photosensitive drum;

a drum grounding contact exposed through a hole formed in said projection, wherein said drum grounding contact is effective to electrically ground said electrophotographic photosensitive drum to the main assembly of said apparatus when said process cartridge is mounted to the main assembly of said apparatus;

a charging roller for electrically charging said electrophotographic photosensitive drum supported on said first cartridge frame;

a developing roller, supported on said second cartridge frame, for developing a latent image formed on said electrophotographic photosensitive drum;

a charging bias contact, supported on said first cartridge frame, for receiving a charging bias to be applied to said charging roller from the main assembly of said apparatus when said process cartridge is mounted to the main assembly of said apparatus;

a developing bias contact, supported on said second cartridge frame, for receiving a developing bias to be applied to said developing roller from the main assembly of said apparatus when said process cartridge is mounted on the main assembly of said apparatus;

detecting contact, supported on said second cartridge frame, for notifying the main assembly of said apparatus that said process cartridge is mounted on the main assembly of said apparatus;

wherein said charging bias contact is provided on a bottom surface, when said process cartridge is mounted to the main assembly of said apparatus, of said first cartridge frame adjacent said one longitudinal end of said electrophotographic photosensitive drum, and said charging bias contact is exposed from said first cartridge frame, wherein said developing bias contact and said detecting contact are provided on a bottom surface, when said process cartridge is mounted to the main assembly of said apparatus, of said second cartridge frame adjacent said one longitudinal end of said electrophotographic photosensitive drum, and said developing bias contact and said detecting contact are exposed from said second cartridge frame.

8. A process cartridge according to claim 7, wherein said drum grounding contact is a free end of a rod-like member which is electrically connected with an inner surface of said electrophotographic photosensitive drum through a grounding plate.

9. A process cartridge according to claim 7 or 8, wherein said projection is in the form of a twisted prism.

10. An electrophotographic image forming apparatus for forming an image on a recording material, to which a process cartridge is detachably mountable, said apparatus comprising:

(a) a mounting member for detachably mounting a process cartridge, said process cartridge including:

a cartridge frame;

an electrophotographic photosensitive drum;

a cartridge coupling member for receiving a driving force for rotating said electrophotographic photosensitive drum from the main assembly of said apparatus when said process cartridge is mounted to said main assembly of said apparatus, wherein said coupling member is provided on one longitudinal end of said electrophotogrpahic photosensitive, drum wherein said cartridge coupling member is disposed on a surface of said cartridge frame facing in a direction crossing a mounting direction of said process cartridge into the apparatus;

a charging member for charging said electrophotographic photosensitive drum;

a developing member for developing a latent image formed on said electrophotographic photosensitive drum;

a charging bias contact for receiving a charging bias to be applied to said charging member from the main assembly of said apparatus when said process cartridge is mounted to the main assembly of said apparatus;

a developing bias contact for receiving a developing bias to be applied to said developing member from the main assembly of said apparatus when said process cartridge is mounted to the main assembly of said apparatus; and a detecting contact for notifying the main assembly of said apparatus that said process cartridge is mounted to the main assembly of said apparatus;

wherein said charging bias contact, said developing bias contact and said detecting contact are provided on a bottom surface, when said process cartridge is mounted to the main assembly of said apparatus, of said cartridge frame adjacent said one longitudinal end of said electrophotographic photosensitive drum, and said charging bias contact, said developing bias contact, and said detecting contact are exposed from said cartridge frame;

said apparatus further comprising:

(b) a main assembly coupling member for engagement with said cartridge coupling member of said process cartridge when said process cartridge is mounted to the main assembly of said apparatus to transmit a driving force to said cartridge coupling member;

(c) a main assembly charging bias contact for electrical connection with said charging bias contact of said process cartridge when said process cartridge is mounted to the main assembly of said apparatus;

(d) a main assembly developing bias contact for electrical connection with developing bias contact of said process cartridge when said process cartridge is mounted to the main assembly of said apparatus; and (e) a main assembly detection contact for electrical connection with said detecting contact of said process cartridge when said process cartridge is mounted to the main assembly of said apparatus.

11. An electrophotographic image forming apparatus for forming an image on a recording material, to which a process cartridge is detachably mountable, said apparatus comprising:

(a) a mounting member for detachably mounting said process cartridge, said process cartridge including:

a first cartridge frame;

a second cartridge frame which is pivotable relative to said first cartridge frame;

an electrophotographic phootsensitive drum supported on said first cartridge frame;

a projection for receiving a driving force for rotating said electrophotographic photosensitive drum from the main assembly of said apparatus when said process cartridge is mounted to the main assembly of said apparatus, wherein said projection is provided on one longitudinal end of said electrophotographic photosensitive drum coaxially with said electrophotographic photosensitive drum;

a drum grounding contact exposed through a hole formed in said projection, wherein said drum grounding contact is effective to electrically ground said electrophotographic photosensitive drum to the main assembly of said apparatus when said process cartridge is mounted to the main assembly of said apparatus;

a charging roller for electrically charging said electrophotographic photosensitive drum supported on said first cartridge frame;

a developing roller, supported on said second cartridge frame, for developing a latent image formed on said electrophotographic photosensitive drum;

a charging bias contact, supported on said first cartridge frame, for receiving a charging bias to be applied to said charging roller from the main assembly of said apparatus when said process cartridge is mounted to the main assembly of said apparatus;

a developing bias contact, supported on said second cartridge frame, for receiving a developing bias to be applied to said developing roller from the main assembly of said apparatus when said process cartridge is mounted on the main assembly of said apparatus; and a detecting contact, supported on said second cartridge frame, for notifying the main assembly of said apparatus that said process cartridge is mounted on the main assembly of said apparatus;

wherein said charging bias contact is provided on a bottom surface, when said process cartridge is mounted to the main assembly of said apparatus, of said first cartridge frame adjacent said one longitudinal end of said electrophotographic photosensitive drum, and said charging bias contact is exposed from said first cartridge frame, wherein said developing bias contact and said detecting contact are provided on a bottom surface, when said process cartridge is mounted to the main assembly of said apparatus, of said second cartridge frame adjacent said one longitudinal end of said electrophotographic photosensitive drum, and said developing bias contact and said detecting contact are exposed from said second cartridge frame;

said apparatus further comprising:

(b) a main assembly hole for engagement with said projection of said process cartridge to transmit the driving force to said projection when said process cartridge is mounted to the main assembly of said apparatus;

(c) a main assembly charging bias contact for electrical connection with said charging bias contact of said process cartridge when said process cartridge is mounted to the main assembly of said apparatus;

(d) a main assembly developing bias contact for electrical connection with said developing bias contact of said process cartridge when said process cartridge is mounted to the main assembly of said apparatus;

(e) a main assembly detection contact for electrical connection with said detecting contact of said process cartridge when said process cartridge is mounted to the main assembly of said apparatus; and (f) a main assembly drum grounding contact for electrical connection with said drum grounding contact of said process cartridge when said process cartridge is mounted to the main assembly of said apparatus.

12. An apparatus according to claim 10, wherein said main assembly coupling member has a polygonal cross-section.

13. An apparatus according to claim 12, wherein said hole is twisted.

14. An apparatus according to claim 11, wherein said main assembly hole has a polygonal cross-section.

15. An apparatus according to claim 14, wherein said hole is twisted.

16. A process cartridge detachably mountable to a main assembly of an electrophotographic image forming apparatus, wherein said main assembly includes a motor, a driving rotatable member for receiving a driving force from said motor and a hole defined by twisted surfaces, said hole being substantially coaxial with said driving rotatable member, said process cartridge comprising:

a first cartridge frame;

a second cartridge frame which is pivotable relative to said first cartridge frame;

an electrophotographic photosensitive drum supported on said first cartridge frame;

a twisted projection engageable with said twisted surfaces, said projection being provided at a longitudinal end of said photosensitive drum;

a charging roller for electrically charging said electrophotographic photosensitive drum supported on said first cartridge frame;

a developing roller, supported on said second cartridge frame, for developing a latent image formed on said electrophotographic photosensitive drum;

a charging bias contact, supported on said first cartridge frame, for receiving a charging bias to be applied to said charging roller from the main assembly of said apparatus when said process cartridge is mounted to the main assembly of said apparatus;

a developing bias contact, supported on said second cartridge frame, for receiving a developing bias to be applied to said developing roller from the main assembly of said apparatus when said process cartridge is mounted on the main assembly of said apparatus; and a detecting contact, supported on said second cartridge frame, for notifying the main assembly of said apparatus that said process cartridge is mounted on the main assembly of said apparatus;

wherein said charging bias contact is provided on a bottom surface, when said process cartridge is mounted to the main assembly of said apparatus, of said first cartridge frame adjacent said one longitudinal end of said electrophotographic photosensitive drum, and said charging bias contact is exposed from said first cartridge frame, wherein said developing bias contact and said detecting contact are provided on a bottom surface, when said process cartridge is mounted to the main assembly of said apparatus, of said second cartridge frame adjacent said one longitudinal end of said electrophotographic photosensitive drum, and said developing bias contact and said detecting contact are exposed from said second cartridge frame; and wherein, when said driving rotatable member rotates with said hole and projection engaged with each other, a rotational driving force is transmitted from said driving rotatable member to said photosensitive drum through engagement between said hole and said projection.

17. A process cartridge which is detachable mountable to a main assembly of an electrophotographic image forming apparatus for forming an image on a recording material, the apparatus including a motor; a main assembly gear for transmitting a rotational driving force from the motor and having a twisted hole formed therein at a central portion thereof having a substantially triangular cross-section, said process cartridge comprising:

a first cartridge frame;

a second cartridge frame which is pivotable relative to said first cartridge frame;

an electrophotographic photosensitive drum supported on said first cartridge frame;

a twisted projection in the form of a substantially triangular prism provided at a longitudinal end of said electrophotographic photosensitive drum, said twisted projection being engageable with the twisted hole;

a drum grounding contact exposed through a hole formed in said projection, wherein said drum grounding contact is effective to electrically ground said electrophotographic photosensitive drum to the main assembly of said apparatus when said process cartridge is mounted to the main assembly of said apparatus;

a charging roller for electrically charging said electrophotographic photosensitive drum supported on said first cartridge frame;

a developing roller, supported on said second cartridge frame, for developing a latent image formed on said electrophotographic photosensitive drum;

a charging bias contact, supported on said first cartridge frame, for receiving a charging bias to be applied to said charging roller from the main assembly of said apparatus when said process cartridge is mounted to the main assembly of said apparatus;

a developing bias contact, supported on said second cartridge frame, for receiving a developing bias to be applied to said developing roller from the main assembly of said apparatus when said process cartridge is mounted on the main assembly of said apparatus; and a detecting contact, supported on said second cartridge frame, for notifying the main assembly of said apparatus that said process cartridge is mounted on the main assembly of said apparatus;

wherein said charging bias contact is provided on a bottom surface, when said process cartridge is mounted to the main assembly of said apparatus, of said first cartridge frame adjacent said one longitudinal end of said electrophotographic photosensitive drum, and said charging bias contact is exposed from said first cartridge frame, wherein said developing bias contact and said detecting contact are provided on a bottom surface, when said process cartridge is mounted to the main assembly of said apparatus, of said second cartridge frame adjacent said one longitudinal end of said electrophotographic photosensitive drum, and said developing bias contact and said detecting contact are exposed from said second cartridge frame; and wherein the rotational driving force is transmitted from the main assembly gear to said electrophotographic photosensitive drum by engagement between said twisted hole and said twisted projection, and wherein said twisted projection is urged toward said twisted hole when the main assembly gear is rotated with said twisted projection being in engagement with the twisted hole when said process cartridge is mounted to the main assembly.

18. A process cartridge which is detachably mountable to a main assembly of an electrophotographic image forming apparatus for forming an image on a recording material, the apparatus including a motor; a main assembly gear for transmitting a rotational driving force from the motor and having a twisted hole formed therein at a central portion thereof and having a non-circular cross-section with a plurality of corner portions, said process cartridge comprising:

a first cartridge frame;

a second cartridge frame which is pivotable relative to said first cartridge frame;

an electrophotographic photosensitive drum supported on said first cartridge frame;

a plurality of engageable portions engageable to an inner surface of said twisted hole, said engageable portions being provided at and supported by an end of said electrophotographic photosensitive member, a drum grounding contact electrically connected with said photosensitive drum for electrically grounding said photosensitive drum when said process cartridge is mounted to the main assembly of said apparatus, said drum grounding contact being such that said engageable portions are provided around said drum grounding contact, a charging roller for electrically charging said electrophotographic photosensitive drum supported on said first cartridge frame;

a developing roller, supported on said second cartridge frame, for developing a latent image formed on said electrophotographic photosensitive drum;

a charging basis contact, supported on said first cartridge frame, for receiving a charging bias to be applied to said charging roller from the main assembly of said apparatus when said process cartridge is mounted to the main assembly of said apparatus;

a developing bias contact, supported on said second cartridge frame, for receiving a developing bias to be applied to said developing roller from the main assembly of said apparatus when said process cartridge is mounted on the main assembly of said apparatus; and a detecting contact, supported on said second cartridge frame, for notifying the main assembly of said apparatus that said process cartridge is mounted on the main assembly of said apparatus;

wherein said charging bias contact is provided on a bottom surface, when said process cartridge is mounted to the main assembly of said apparatus, of said first cartridge frame adjacent said one longitudinal end of said electrophotographic photosensitive drum, and said charging bias contact is exposed from said first cartridge frame, wherein said developing bias contact and said detecting contact are provided on a bottom surface, when said process cartridge is mounted to the main assembly of said apparatus, of said second cartridge frame adjacent said one longitudinal end of said electrophotographic photosensitive drum, and said developing bias contact and said detecting contact are exposed from said second cartridge frame; and wherein when said rotatable driving member rotates with said hole and said engageable portions engaged with each other, the rotational driving force is transmitted from said main assembly gear to said photosensitive drum through engagement between said twisted hole and said engageable portions when said process cartridge is mounted to the main assembly.

19. A process cartridge according to claim 18, said engageable portions are provided at an outer surface of a projection.

20. A process cartridge according to claim 19, said drum grounding contact is positioned coaxially with said projection.

* * * * *

UNITED STATES PATENT AND TRADEMARK OFFICE

CERTIFICATE OF CORRECTION

PATENT NO. : 6,185,390 B1
DATED : February 6, 2001
INVENTOR(S) : Akira Higeta, et al.

It is certified that error appears in the above-identified patent and that said Letters Patent is hereby corrected as shown below:

Column 3,
Line 46, "adjacent" should read -- areas adjacent --.
Line 66, "horizontal direction" should read -- "horizontal direction" --.

Column 9,
Line 33, "force a" should read -- a force --.

Column 12,
Line 42, "under" should read -- is under --.

Column 13,
Line 49, "equilaterally" should read -- equilateral --.

Column 14,
Line 7, "an in" should read -- in an --.
Line 30, "When" should read -- With --.

Column 19,
Line 28, "such" should be deleted, and "design" should read -- design such --.

Column 20,
Line 56, "slight" should read slightly --.

Column 22,
Line 4, "electrode" should read -- electrodes --.

Column 24,
Line 29, "he" should read -- the --.

Column 25,
Line 54, "be," should read -- be detected, --.

Column 26,
Line 30, "detecting" should read -- a detecting --.

UNITED STATES PATENT AND TRADEMARK OFFICE

CERTIFICATE OF CORRECTION

PATENT NO. : 6,185,390 B1
DATED : February 6, 2001
INVENTOR(S) : Akira Higeta, et al.

It is certified that error appears in the above-identified patent and that said Letters Patent is hereby corrected as shown below:

Column 32,
Line 29, "claim 18," should read -- claim 18, wherein --.
Line 32, "claim 19," should read -- claim 19, wherein --.

Signed and Sealed this

Twenty-seventh day of November, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,185,390 B1
DATED : February 6, 2001
INVENTOR(S) : Akira Higeta, et al.

It is certified that error appears in the above-identified patent and that said Letters Patent is hereby corrected as shown below:

Column 3,
Line 46, "adjacent" should read -- areas adjacent --.
Line 66, "horizontal direction" should read -- "horizontal direction" --.

Column 9,
Line 33, "force a" should read -- a force --.

Column 12,
Line 42, "under" should read -- is under --.

Column 13,
Line 49, "equilaterally" should read -- equilateral --.

Column 14,
Line 7, "an in" should read -- in an --.
Line 30, "When" should read -- With --.

Column 19,
Line 28, "such" should be deleted, and "design" should read -- design such --.

Column 20,
Line 56, "slight" should read -- slightly --.

Column 22,
Line 4, "electrode" should read -- electrodes --.

Column 24,
Line 29, "he" should read -- the --.

Column 25,
Line 54, "be," should read -- be detected, --.

Column 26,
Line 30, "detecting" should read -- a detecting --.

UNITED STATES PATENT AND TRADEMARK OFFICE

CERTIFICATE OF CORRECTION

PATENT NO. : 6,185,390 B1
DATED : February 6, 2001
INVENTOR(S) : Akira Higeta, et al.

It is certified that error appears in the above-identified patent and that said Letters Patent is hereby corrected as shown below:

Column 32,
Line 29, "claim 18," should read -- claim 18, wherein --.
Line 32, "claim 19," should read -- claim 19, wherein --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*